US012233998B2

(12) United States Patent
Nakayasu et al.

(10) Patent No.: US 12,233,998 B2
(45) Date of Patent: Feb. 25, 2025

(54) VESSEL OPERATION SYSTEM AND VESSEL

(71) Applicant: YAMAHA HATSUDOKI KABUSHIKI KAISHA, Iwata (JP)

(72) Inventors: Yoshikazu Nakayasu, Shizuoka (JP); Takuma Ito, Shizuoka (JP); Sho Takagawa, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 473 days.

(21) Appl. No.: 17/699,499

(22) Filed: Mar. 21, 2022

(65) Prior Publication Data

US 2022/0297811 A1 Sep. 22, 2022

(30) Foreign Application Priority Data

Mar. 22, 2021 (JP) ..... 2021-047950

(51) Int. Cl.
*B63H 20/12* (2006.01)
*B63H 25/02* (2006.01)
*B63H 20/00* (2006.01)

(52) U.S. Cl.
CPC ..... *B63H 20/12* (2013.01); *B63H 25/02* (2013.01); *B63H 2020/003* (2013.01); *B63H 2025/022* (2013.01)

(58) Field of Classification Search
CPC .. B63H 20/00; B63H 20/12; B63H 2020/003; B63H 25/00; B63H 25/02; B63H 2025/022
USPC ..... 114/144 R
See application file for complete search history.

(56) References Cited

U.S. PATENT DOCUMENTS

| | | | | |
|---|---|---|---|---|
| 6,843,195 | B2 | 1/2005 | Watabe et al. | |
| 7,270,068 | B2 * | 9/2007 | Mizutani | B63H 25/02 114/144 R |
| 2010/0273369 | A1 | 10/2010 | Furuya et al. | |
| 2015/0072575 | A1 | 3/2015 | Mizutani | |
| 2020/0331578 | A1 | 10/2020 | Sakashita et al. | |

FOREIGN PATENT DOCUMENTS

| | | | |
|---|---|---|---|
| JP | 5186462 | B2 | 4/2013 |
| JP | 2015-054627 | A | 3/2015 |
| JP | 2020-168921 | A | 10/2020 |

* cited by examiner

*Primary Examiner* — Lars A Olson
(74) *Attorney, Agent, or Firm* — Keating & Bennett, LLP

(57) ABSTRACT

A vessel operation system includes a propulsion apparatus mountable on a hull of a vessel and that includes a prime mover, a steering to change a steering angle of a thrust generated by the propulsion apparatus with respect to the hull, a speed sensor to detect a speed corresponding to a traveling speed of the vessel or a rotational speed of the prime mover, and a controller configured or programmed to control the steering so as to change a maximum value of the steering angle in accordance with a speed data based on the speed detected by the speed sensor.

19 Claims, 19 Drawing Sheets

VESSEL OPERATION SYSTEM AND VESSEL

CROSS REFERENCE TO RELATED APPLICATIONS

This application claims the benefit of priority to Japanese Patent Application No. 2021-047950 filed on Mar. 22, 2021. The entire contents of this application are hereby incorporated herein by reference.

BACKGROUND OF THE INVENTION

1. Field of the Invention

The present invention relates to a vessel operation system and a vessel including such a system.

2. Description of the Related Art

Japanese Patent Application Publication No. 2020-168921 discloses a vessel including a hull and a propulsion system for vessels that is mounted on the hull and that is an example of a vessel operation system. This vessel additionally includes a steering wheel, a throttle lever, and a joystick that are disposed at a vessel operation seat of the hull. The propulsion system for vessels includes a pair of left and right outboard motors attached to a stern of the hull. Each of the outboard motors includes a propulsion unit that is turnable around a vertical turning shaft and that generates a thrust, and includes an attachment mechanism that attaches the propulsion unit to the stern. When the propulsion unit turns around the vertical turning shaft, a steering angle that is a direction of the thrust with respect to a center line of the hull is changed, and therefore steering of the vessel is achieved.

The steering wheel is operated by a vessel operator for steering. The throttle lever is operated by the vessel operator to adjust the output of each of the outboard motors. The joystick is operated by the vessel operator for steering and for adjusting the output of each of the outboard motors. Therefore, in this vessel, a steering vessel operation by use of both the steering wheel and the throttle lever and a joystick vessel operation by use of the joystick are available. In the joystick vessel operation, for example, the vessel operator rightwardly tilts the joystick. Thereupon, the left outboard motor is controlled so that the propulsion unit leftwardly turns and generates a right-forward thrust, whereas the right outboard motor is controlled so that the propulsion unit rightwardly turns and generates a right-backward thrust. When a resultant force of these thrusts, i.e., a composite thrust acts on the hull, the vessel rightwardly makes a lateral movement.

SUMMARY OF THE INVENTION

The inventor of preferred embodiments of the present invention described and claimed in the present application conducted an extensive study and research regarding a vessel operation system, such as the one described above, and in doing so, discovered and first recognized new unique challenges and previously unrecognized possibilities for improvements as described in greater detail below.

In a vessel capable of changing between the steering vessel operation and the joystick vessel operation, it is convenient and general to use the steering vessel operation when traveling at a high speed and to use the joystick vessel operation when traveling at a low speed, e.g., for launching from and docking on shore, etc., although this is not described in Japanese Patent Application Publication No. 2020-168921.

In a conventional vessel operation system, the maximum value of a steering angle is fixed regardless of a difference in a vessel operation mode (steering vessel operation or joystick vessel operation) or a difference in a traveling speed. If the maximum value of the steering angle is small, a right-left direction component of a thrust, which is obtained in a state in which the propulsion unit has turned to the maximum steering angle, is small. Therefore, the vessel operator might feel that a sufficient rightward thrust cannot be obtained, for example, when the vessel operator rightwardly tilts the joystick in the joystick vessel operation. Additionally, if the maximum value of the steering angle is small when an interval between the left and right outboard motors is wide, a moving range of an intersection between an acting line of a thrust of the left outboard motor and an acting line of a thrust of the right outboard motor is limited to an area at a more forward position than a resistant center of the hull. Therefore, even if the vessel operator attempts to laterally move the vessel in parallel by the joystick vessel operation, a composite thrust acts on the intersection spaced forwardly from the resistant center, and the veering moment acts on the hull. Therefore, the conventional vessel operation system has room for improvement for a more excellent vessel operation feeling.

In order to overcome the previously unrecognized and unsolved challenges described above, a preferred embodiment of the present invention provides a vessel operation system to be installed on a vessel and including a propulsion apparatus mountable on a hull of the vessel, a steering to change a steering angle of a thrust generated by the propulsion apparatus with respect to the hull, a speed sensor, and a controller. The propulsion apparatus includes a prime mover, and generates the thrust based on a drive force generated by the prime mover. The speed sensor detects a speed corresponding to a traveling speed of the vessel or a rotational speed of the prime mover. The controller is configured or programmed to control the steering so as to change a maximum value of the steering angle in accordance with speed data based on a speed detected by the speed sensor.

With this structural arrangement, the maximum value of the steering angle changes in accordance with the speed data. Therefore, it is possible to realize a more excellent operation feeling than the conventional vessel operation system in which the maximum value of the steering angle is fixed.

The speed data may be the speed detected by the speed sensor. The speed data may be a pseudo speed corresponding to the speed detected by the speed sensor subjected to a smoothing filter process. A better operation feeling may be attained by using the pseudo speed.

In a preferred embodiment of the present invention, the controller is configured or programmed to set the maximum value of the steering angle at a first set value when the speed data is a predetermined threshold value or more. The controller is configured or programmed to set the maximum value of the steering angle at a second set value larger than the first set value when the speed data is less than the threshold value.

With this structural arrangement, the maximum value of the steering angle is set at the first set value when the speed data is the threshold value or more, and, on the other hand, the maximum value of the steering angle is set at the second set value larger than the first set value when the speed data is comparatively low and is less than the threshold value. Therefore, it is possible to enlarge a right-left direction component of the thrust by a large steering angle when traveling at a low speed. This makes it possible to obtain a large thrust component in the left-right direction when traveling at a low speed, thus making it possible to improve a vessel operation feeling.

In a preferred embodiment of the present invention, the threshold value may correspond to the speed data when the vessel starts to plane on a water surface.

A preferred embodiment of the present invention provides a vessel operation system to be installed on a vessel and that includes a propulsion apparatus mountable on a hull of the vessel, a steering to change a steering angle of a thrust generated by the propulsion apparatus with respect to the hull, a first operator, a second operator, and a controller. The first operator generates a first vessel operation command by being operated by a vessel operator. The second operator is provided separately from the first operator, and generates a second vessel operation command by being operated by the vessel operator. The controller is configured or programmed to control the steering within a maximum steering angle of a first set value in response to the first vessel operation command, and to control the steering within a maximum steering angle of a second set value larger than the first set value in response to the second-vessel operation command.

With this structural arrangement, the maximum value of the steering angle is set at the first set value and the second set value in accordance with the operation of the first operator and the operation of the second operator, respectively, by the vessel operator. Therefore, it is possible to appropriately set the maximum value of the steering angle in accordance with the operators.

For example, the first operator may be suitable for a vessel operation during high-speed traveling, and the second operator may be suitable for a vessel operation during low-speed traveling. When the second operator is operated to move the vessel in the left-right direction during low-speed traveling, the maximum value of the steering angle is set at the second set value larger than the first set value. This makes it possible to obtain a large thrust in the left-right direction because a thrust generated by the propulsion apparatus when the steering angle increases beyond the first set value has a large right-left direction component, thus making it possible to improve a vessel operation feeling.

In a preferred embodiment of the present invention, the second operator is a joystick.

With this structural arrangement, when the joystick is operated by the vessel operator, the maximum value of the steering angle is set at the second set value larger than the first set value. Therefore, when the vessel operator moves the vessel in the left-right direction while operating the joystick, it is possible to obtain a large thrust in the left-right direction because a thrust generated by the propulsion apparatus when the steering angle increases beyond the first set value has a large right-left direction component, and it is possible to achieve excellent vessel operation responsiveness. This makes it possible to improve a vessel operation feeling.

In a preferred embodiment of the present invention, the vessel operation system includes a plurality of the propulsion apparatuses mountable on the hull and arranged side-by-side in a left-right direction of the hull. The second set value is determined so that an intersection position between acting lines of thrusts generated by the plurality of propulsion apparatuses is changeable in a range including a resistant center of the hull, a more forward position than the resistant center, and a more rearward position than the resistant center.

This structural arrangement enables the intersection position between the acting lines of thrusts generated by the plurality of propulsion apparatuses to be located at forward and rearward positions with respect to the resistant center of the hull and to coincide with the resistant center. Thus, it becomes possible to freely control veering and translational movement of the hull, and therefore the vessel is moved in various behaviors. This makes it possible to improve a vessel operation feeling.

In a preferred embodiment of the present invention, the second set value may be about 30 degrees or more when the steering angle corresponding to the acting line extending in the front-rear direction is defined as 0 degrees.

In a preferred embodiment of the present invention, the propulsion apparatus is an outboard motor located at a stern of the hull and that is turnable around a vertical shaft. The second set value is equal to a turnable angle of the outboard motor.

With this structural arrangement, if the propulsion apparatus is an outboard motor, the second set value concerning the maximum value of the steering angle is equal to the turnable angle of the outboard motor. Thus, it is possible to turn the outboard motor up to the turnable angle when the second set value is applied, and therefore it is possible to use the maximum right-left direction component of a thrust generated by the outboard motor. This makes it possible to obtain a sufficient thrust in the left-right direction, thus making it possible to improve a vessel operation feeling.

A preferred embodiment of the present invention provides a vessel operation system to be installed on a vessel. The vessel operation system includes a propulsion apparatus mountable on a hull of the vessel that includes a prime mover, and that generates a thrust based on a drive force generated by the prime mover, a steering to change a steering angle of a thrust generated by the propulsion apparatus with respect to the hull, a speed sensor to detect a speed corresponding to a traveling speed of the vessel or a rotational speed of the prime mover, and a controller configured or programmed to control the steering so as to change the steering angle in accordance with speed data, wherein the speed data is the traveling speed detected by the speed sensor or a pseudo rotational speed corresponding to the rotational speed detected by the speed sensor subjected to a smoothing filter process.

In a preferred embodiment of the present invention, the vessel operation system further includes a steering wheel operated by an operator, wherein the controller is configured or programmed to control the steering to change the steering angle in accordance with the speed data even when an operation angle of the steering wheel is unchanged.

In a preferred embodiment of the present invention, the controller is configured or programmed to control the steering when the operation angle of the steering wheel is unchanged such that the larger the speed data is (i.e., the higher speed the speed data corresponds to), the smaller the steering angle is.

In a preferred embodiment of the present invention, the controller is configured or programmed to determine a target steering angle in accordance with a three-dimensional map including a three-dimensional curved surface that defines the target steering angle in relation to the operation angle of the steering wheel and the speed data, and to control the steering in accordance with the determined target steering angle.

In a preferred embodiment of the present invention, the vessel operation system further includes a steering wheel operated by an operator, and a steering characteristic setter. The controller is configured or programmed to change a characteristic of the steering angle with respect to an operation angle of the steering wheel and/or a characteristic of the steering angle with respect to the speed data.

A preferred embodiment of the present invention provides a vessel including a hull and the vessel operation system mounted on the hull.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
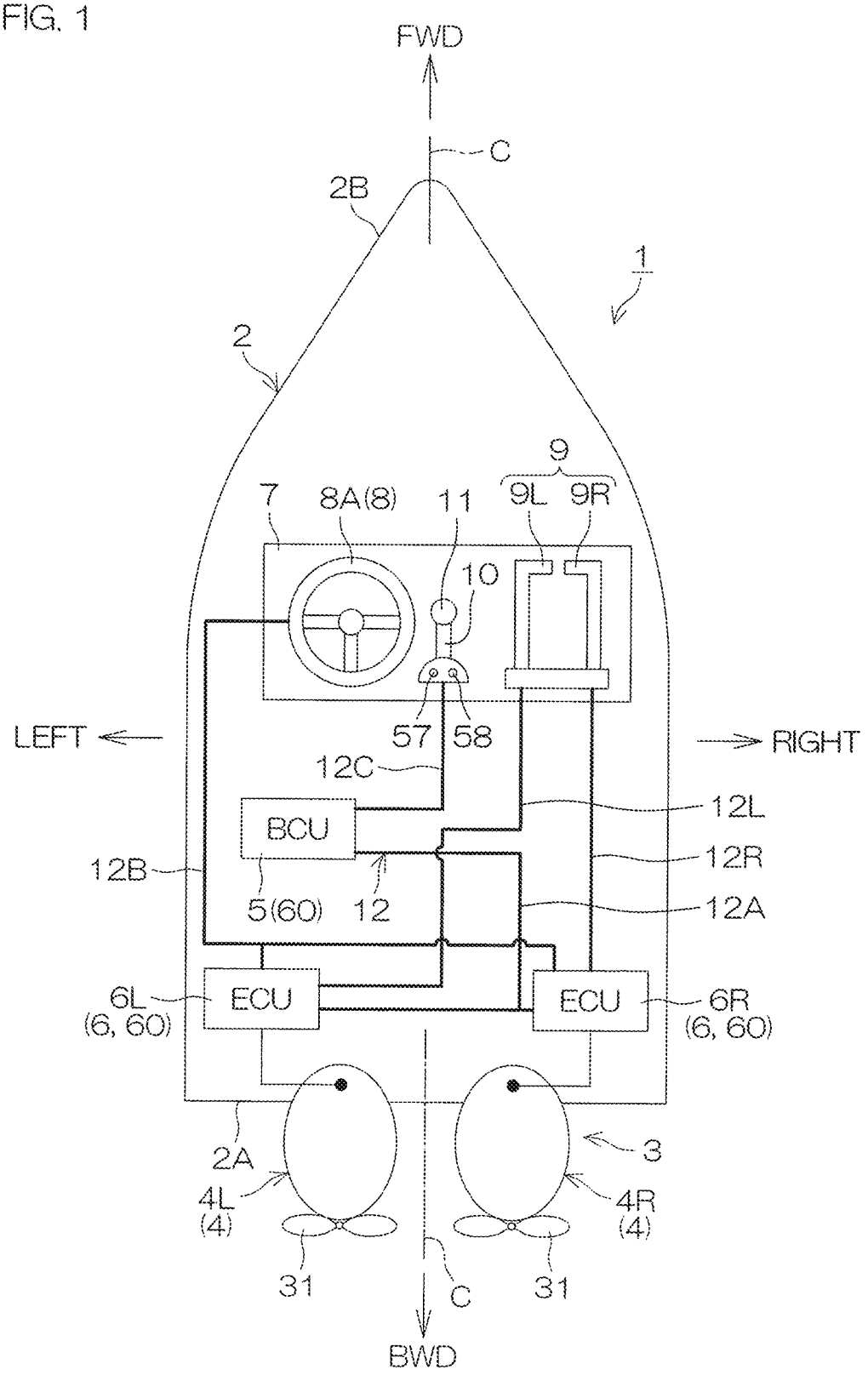
FIG. 1 is a conceptual diagram to describe an arrangement of a vessel according to a preferred embodiment of the present invention.

Preferred embodiments of the present invention will be hereinafter described in detail with reference to the accompanying drawings. FIG. 1 is a conceptual diagram to describe an arrangement in a plan view of a vessel 1 according to a preferred embodiment of the present invention. In FIG. 1, a forward direction (bow direction) of the vessel 1 is represented by an arrow FWD, and a backward direction (stern direction) thereof is represented by an arrow BWD.

Additionally, a right-hand side (starboard side) direction of the vessel 1 is represented by an arrow RIGHT, and a left-hand side (port side) direction thereof is represented by an arrow LEFT.

A vessel 1 includes a hull 2 and a vessel operation system 3 mounted on the hull 2. The vessel operation system 3 includes a plurality of outboard motors 4, which are an example of a propulsion apparatus mountable on the hull 2, and a BCU (boat control unit) 5 that controls the outboard motors 4.

The plurality of outboard motors 4 are designed so as to be mounted and arranged side-by-side in a left-right direction at a stern 2A of the hull 2 and so as to generate a thrust at a more rearward position than a resistant center P (see FIG. 4 etc., described below) that is a momentary turning center of the hull 2. The resistant center P does not necessarily coincide with the gravity center of the hull 2 in a plan view, and is not necessarily located at a fixed position in the hull 2.

In the present preferred embodiment, the plurality of outboard motors 4 include a left outboard motor 4L and a right outboard motor 4R that are attached to the stern 2A. The left and right outboard motors 4L and 4R are attached to laterally symmetrical positions with respect to a center line C that passes through the stern 2A and the bow 2B of the hull 2 and extends in the front-rear direction. More specifically, the left outboard motor 4L is attached to a rear portion of the left-hand side of the hull 2, and the right outboard motor 4R is attached to a rear portion of the right-hand side of the hull 2. For example, an interval between the left outboard motor 4L and the right outboard motor 4R in the left-right direction may be a standard pitch of about 28.5 inches, or may be a large pitch of about 35 to about 40 inches.

An ECU 6 (electronic control unit), which is an example of a controller, is built into each of the left and right outboard motors 4L and 4R. The BCU 5 and the ECUs 6 each include a microcomputer including a CPU (central processing unit) and a memory, and the microcomputer executes a predetermined software process. The ECU 6 built into the left outboard motor 4L is hereinafter referred to as the "left ECU 6L," and the ECU 6 built into the right outboard motor 4R is hereinafter referred to as the "right ECU 6R." However, for convenience, the left outboard motor 4L and the left ECU 6L are depicted in a state of being separated from each other, and the right outboard motor 4R and the right ECU 6R are depicted in a state of being separated from each other in FIG. 1.

An operational platform 7 for vessel operations is located at the vessel operation seat of the hull 2. The operational platform 7 is provided with a steering operation portion 8 operated to steer the vessel, a throttle operation portion 9 operated to adjust the output of each of the outboard motors 4, and a joystick 10 operated to steer the vessel and to adjust the output of each of the outboard motors 4. The steering operation portion 8 and the throttle operation portion 9 are each an example of a first operator operated by a vessel operator for vessel operations. The joystick 10 is an example of a second operator that is separate from the first operator and that is operated by the vessel operator for vessel operations. These operators are included in the vessel operation system 3.

In the present preferred embodiment, an ordinary vessel operation (which is hereinafter referred to as "steering vessel operation") that uses the steering operation portion 8 and the throttle operation portion 9 and a vessel operation (which is hereinafter referred to as "joystick vessel operation") that uses the joystick 10 are available. In the operational platform 7, for example, the steering operation portion 8 is located at a position closer to the left, and the throttle operation portion 9 is located at a position closer to the right, and the joystick 10 is located between the steering operation portion 8 and the throttle operation portion 9. However, these layouts may be arbitrarily changed.

The steering operation portion 8 includes a steering wheel 8A that is turnable rightwardly and leftwardly. The throttle operation portion 9 includes throttle levers 9L and 9R corresponding to the left and right outboard motors 4L and 4R, respectively. The left throttle lever 9L is used to perform the output control of the left outboard motor 4L. The right throttle lever 9R is used to perform the output control of the right outboard motor 4R. The throttle levers 9L and 9R are each turnable within a predetermined angular range in the front-rear direction. The tilt position of the throttle levers 9L and 9R when these are tilted by a predetermined amount forwardly from a neutral position is a forward shift-in position. The tilt position of the throttle levers 9L and 9R when these are tilted by a predetermined amount rearwardly from the neutral position is a backward shift-in position.

Each head portion of the throttle levers 9L and 9R is bent in a direction in which the head portions are adjacent to each other, and define a substantially horizontal gripping portion. This enables the vessel operator to simultaneously turn both of the throttle levers 9L and 9R and to control the output of the left and right outboard motors 4L and 4R while keeping the throttle opening degrees of the left and right outboard motors 4L and 4R so as to be equal or substantially equal to each other. A single lever maneuvering function may be provided to control the output of all the outboard motors 4L and 4R by the operation of one of the throttle levers 9L and 9R.

The joystick 10 is a lever that protrudes from the operational platform 7. The joystick 10 is tiltable freely in any direction, i.e., in forward, rearward, leftward, and rightward directions (including an oblique direction) from a neutral position by being operated by the vessel operator. A knob 11 that can be rotationally operated around an axis of the joystick 10 is located at the head portion of the joystick 10. The knob 11 is a portion of the joystick 10. The entirety of the joystick 10, instead of the knob 11, may be rotationally operated around its axis.

The BCU 5 communicates with each of the ECUs 6 through a communication bus 12 located in the hull 2. The communication bus 12 includes, for example, a CAN (Control Area Network). The communication bus 12 includes a first communication bus 12A that connects the BCU 5 and each of the ECUs 6 together, a second communication bus 12B that connects the steering wheel 8A and each of the ECUs 6 together, and a third communication bus 12C that connects the BCU 5 and the joystick 10 together. The communication bus 12 includes a fourth communication bus 12L that connects the throttle lever 9L and the left ECU 6L together and a fifth communication bus 12R that connects the throttle lever 9R and the right ECU 6R together. An arrangement according to the wiring of the communication bus 12 may be appropriately changed.

Figure 2:
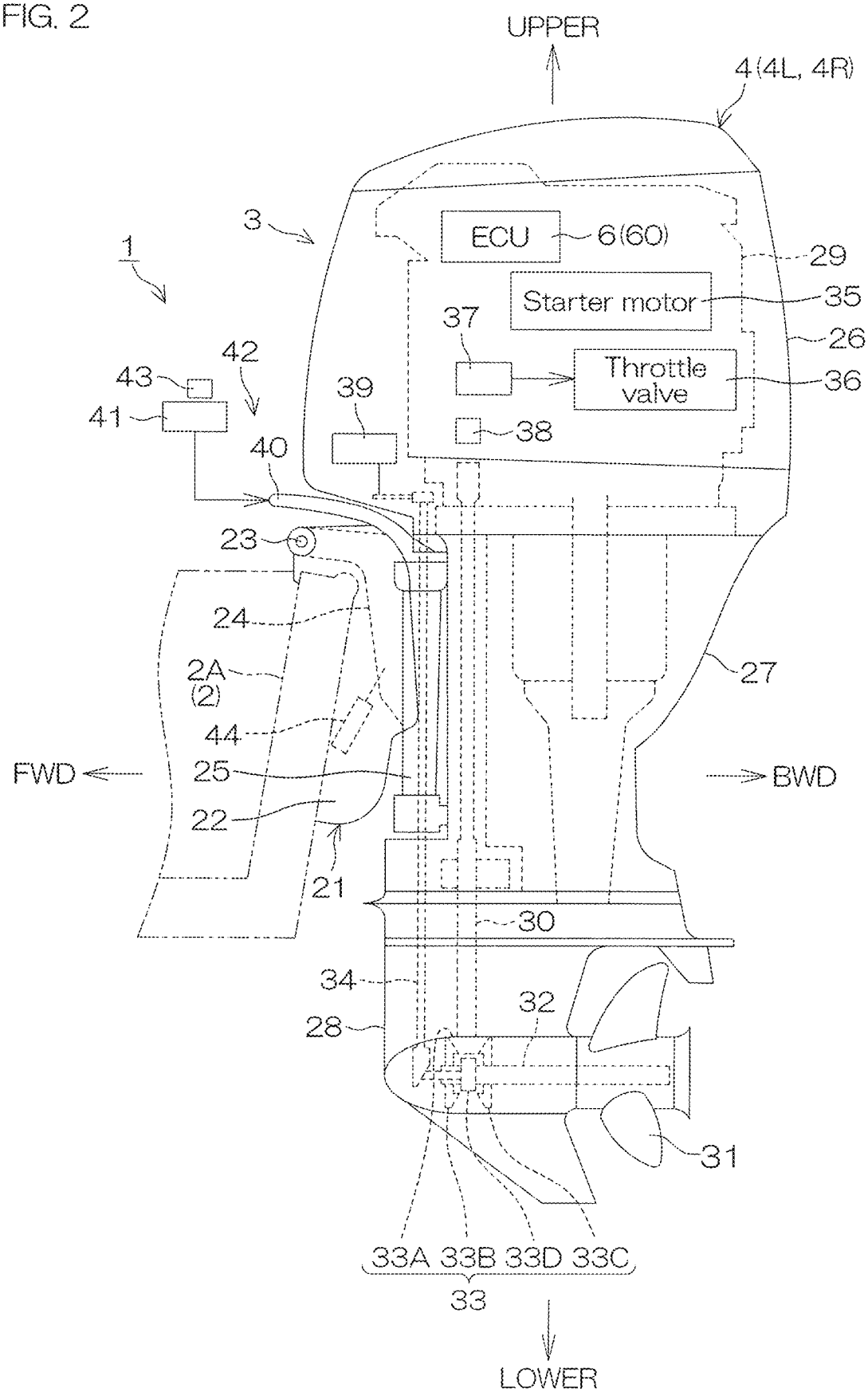
FIG. 2 is an illustrative cross-sectional view to describe an arrangement of a propulsion apparatus included in the vessel.

FIG. 2 is an illustrative cross-sectional view to describe an arrangement common to the left and right outboard motors 4L and 4R. Each of the outboard motors 4 is attached to the stern 2A of the hull 2 through an attachment mechanism 21. The attachment mechanism 21 may be regarded as an element of the outboard motor 4. The attachment mechanism 21 includes a clamp bracket 22 detachably fixed to the stern 2A and a swivel bracket 24 turnably joined to the clamp bracket 22 centering on a tilt shaft 23 that is a horizontal shaft. The trim angle of the outboard motor 4 may be changed by turning the swivel bracket 24 around the tilt shaft 23.

The outboard motor 4 is attached to the swivel bracket 24 turnably around a steering shaft 25 that is a vertical shaft. Thus, it is possible to change a steering angle (direction of a thrust generated by the outboard motor 4 with respect to the center line C of the hull 2) by turning the outboard motor 4 around the steering shaft 25.

A housing of the outboard motor 4 includes a top cowling 26, an upper case 27, and a lower case 28. An engine 29 functioning as a driving source is installed in the top cowling 26 so that an axis of its crankshaft extends in an up-down direction. A drive shaft 30 that is used for power transmission and that is connected to a lower end of the crankshaft of the engine 29 extends in the up-down direction to the inside of the lower case 28 through the inside of the upper case 27. The engine 29 is an example of a prime mover. An electric motor may be used as another example of a prime mover used as a drive source.

A propeller 31 functioning as a thrust generating member is rotatably attached to the rear side of a lower portion of the lower case 28. A propeller shaft 32 that is a rotational shaft of the propeller 31 extends through the inside of the lower case 28 in a horizontal direction. The rotation of the drive shaft 30 is transmitted to the propeller shaft 32 through a shift mechanism 33 including a dog clutch.

The shift mechanism 33 includes a driving gear 33A fixed to a lower end of the drive shaft 30, a forward gear 33B and a backward gear 33C that are turnably provided on the propeller shaft 32, and a slider 33D located between the forward gear 33B and the backward gear 33C. The driving gear 33A, the forward gear 33B, and the backward gear 33C are bevel gears, respectively. The forward gear 33B engages with the driving gear 33A from the front side, whereas the backward gear 33C engages with the driving gear 33A from the rear side. Therefore, the forward gear 33B and the backward gear 33C are rotated in mutually opposite directions.

The slider 33D is spline-coupled to the propeller shaft 32. In other words, the slider 33D is slidable in its axial direction with respect to the propeller shaft 32, and yet cannot turn relatively to the propeller shaft 32, and rotates together with the propeller shaft 32. The slider 33D is slid on the propeller shaft 32 by turning around the shaft of a shift rod 34 extending in the up-down direction in parallel with the drive shaft 30. Thus, the slider 33D is located at any one of the shift positions consisting of a forward position joined to the forward gear 33B, a backward position joined to the backward gear 33C, and a neutral position joined neither to the forward gear 33B nor to the backward gear 33C.

The rotation of the forward gear 33B is transmitted to the propeller shaft 32 through the slider 33D when the slider 33D is in the forward position. Thus, the propeller 31 rotates unidirectionally, and generates a thrust in a direction (forward direction) in which the hull 2 is advanced. The rotation of the propeller 31 at this time is referred to as "positive rotation." On the other hand, the rotation of the backward gear 33C is transmitted to the propeller shaft 32 through the slider 33D when the slider 33D is in the backward position. The backward gear 33C rotates in a direction opposite to that of the forward gear 33B, and therefore the propeller 31 rotates in an opposite direction, and a thrust in a direction (backward direction) in which the hull 2 moves backward is generated. The rotation of the propeller 31 at this time is referred to as "reverse rotation." As thus described, the outboard motor 4 generates a forward thrust or a backward thrust by the engine 29. The rotation of the drive shaft 30 is not transmitted to the propeller shaft 32 when the slider 33D is in the neutral position. In other words, a driving-force-transmitting path between the engine 29 and the propeller 31 is shut off, and therefore a thrust in any direction is not generated.

A starter motor 35 by which the engine 29 is started is located in the outboard motor 4. The starter motor 35 is controlled by the ECU 6. The outboard motor 4 is additionally provided with a throttle actuator 37 that changes the throttle opening degree by actuating a throttle valve 36 of the engine 29 and that changes an intake air flow of the engine 29. The throttle actuator 37 may include an electric motor. The operation of the throttle actuator 37 is controlled by the ECU 6. Therefore, the throttle valve 36 is an electronically-controlled throttle valve. The engine 29 is additionally provided with a throttle-opening-degree sensor 38 that detects the throttle opening degree.

In relation to the shift rod 34, a shift actuator 39 I provided that changes the shift position of the slider 33D. The shift actuator 39 includes, for example, an electric motor, and is operated and controlled by the ECU 6.

A steering rod 40 that, for example, extends forwardly is fixed to the outboard motor 4. A steering actuator 41 controlled by the ECU 6 is joined to the steering rod 40. The steering actuator 41 may include, for example, a DC servo motor and a decelerator. The steering actuator 41 is driven, thus making it possible to turn the outboard motor 4 around the steering shaft 25 and to perform a steering operation. As thus described, a steering 42 that changes a steering angle includes the steering actuator 41, the steering rod 40, and the steering shaft 25 in the outboard motor 4. The steering 42 is included in the vessel operation system 3. The steering 42 is provided with a steering angle sensor 43 that detects a steering angle. The steering angle sensor 43 includes, for example, a potentiometer.

A trim actuator 44 that includes, for example, a hydraulic cylinder and that is controlled by the ECU 6 is located between the clamp bracket 22 and the swivel bracket 24. The trim actuator 44 turns the outboard motor 4 around the tilt shaft 23, and changes a trim angle of the outboard motor 4 by turning the swivel bracket 24 around the tilt shaft 23.

Figure 3:
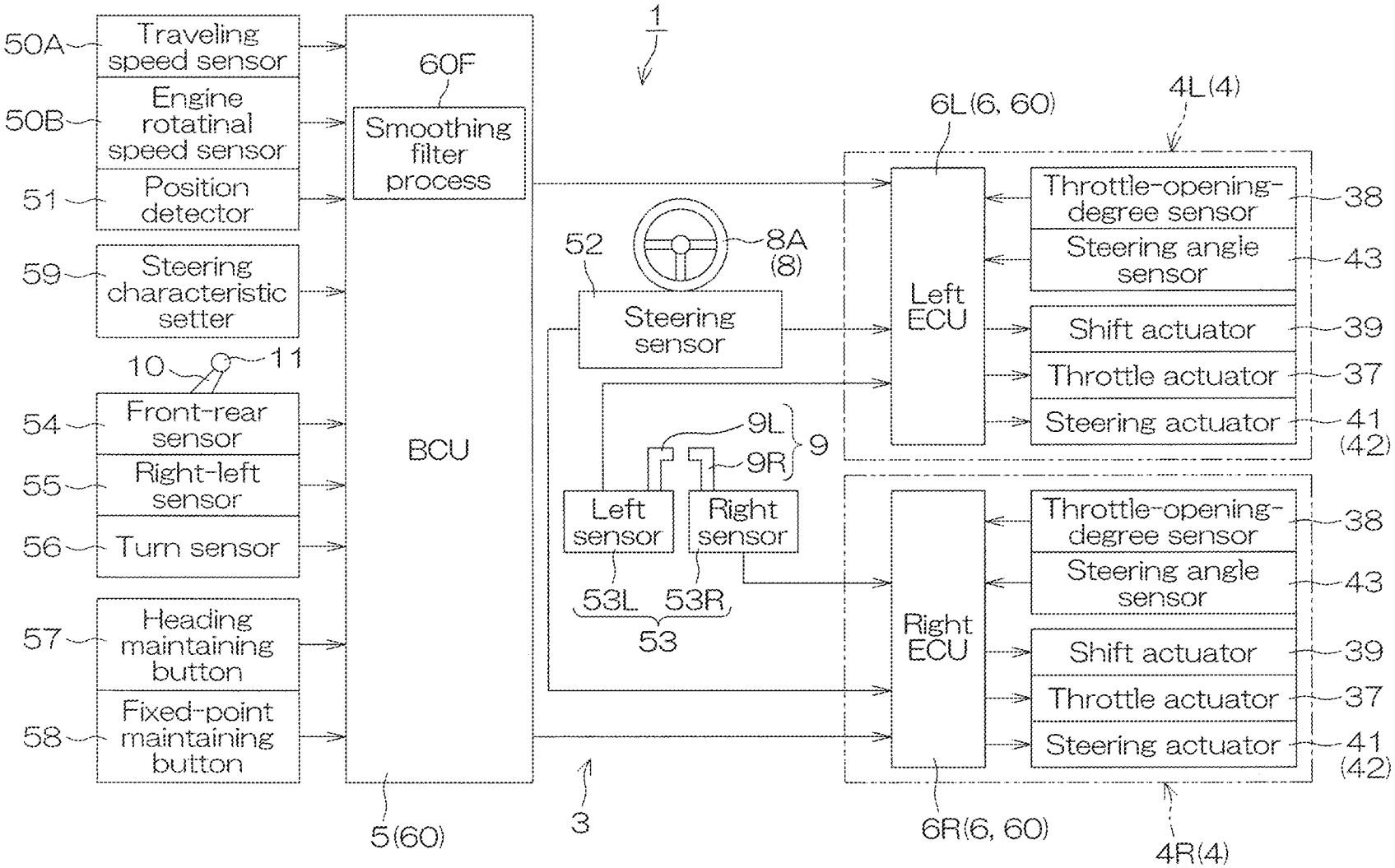
FIG. 3 is a block diagram showing an electrical arrangement of a vessel operation system included in the vessel.

FIG. 3 is a block diagram showing an electrical arrangement of the vessel operation system 3. The vessel operation system 3 includes a traveling speed sensor 50A that detects the traveling speeds of the vessel 1 traveling forwardly and backwardly and then inputs these detected speeds into the BCU 5. The vessel operation system 3 includes an engine rotational speed sensor 50B that detects the rotational speed of the engine 29 as a prime mover and then inputs detected rotational speeds into the BCU 5. The vessel operation system 3 further includes a position detector 51 that generates a present-position signal of the vessel 1 and then inputs this signal into the BCU 5. The traveling speed sensor 50A may include a pitot tube located in the water or the air. The traveling speed sensor 50A may be a log-speed sensor or may be a ground-speed sensor. The traveling speed sensor 50A is an example of a speed sensor. The engine rotational speed sensor 50B detects the rotational speed of the crankshaft of the engine 29. The engine rotational speed sensor is another example of a speed sensor. The position detector 51 generates a present-position signal of the vessel 1, and may include, for example, a GPS receiver that receives radio waves from a GPS (Global Positioning System) satellite and then generates present-position information. The present-position signal may include information concerning the heading of the hull 2 (bow direction). The GPS receiver may be used as a traveling speed sensor because it outputs the moving speed data of the vessel 1.

The vessel operation system 3 additionally includes a steering sensor 52 that detects a turning position (turning direction and turning amount), i.e., an operation angle, of the steering wheel 8A and then inputs the turning position (operation angle) into the left and right ECUs 6L and 6R. The vessel operation system 3 additionally includes left and right sensors 53L and 53R that detect tilt positions (tilt direction and tilt amount) in the front-rear direction of the throttle levers 9L and 9R, respectively, and then input the tilt positions into the left and right ECUs 6L and 6R, respectively. The left sensor 53L and the right sensor 53R are hereinafter referred to generically as the "throttle sensor 53" if necessary. The steering sensor 52 and the throttle sensor 53 may each include a potentiometer.

The vessel operation system 3 additionally includes a front-rear sensor 54 that detects a tilt position in the front-rear direction of the joystick 10 that has been tilted in an arbitrary direction and then inputs the tilt position into the BCU 5 and a right-left sensor 55 that detects a tilt position in the left-right direction of the joystick 10 and then inputs the tilt position into the BCU 5. When the joystick 10 is tilted in an oblique direction, which includes both the front-rear direction and the left-right direction, the oblique direction is broken down into the front-rear direction and the left-right direction, and the tilt position in the front-rear direction is detected by the front-rear sensor 54, and the tilt position in the left-right direction is detected by the right-left sensor 55. The vessel operation system 3 additionally includes a turn sensor 56 that detects a turning position of the knob 11 and then inputs the turning position into the BCU 5. The front-rear sensor 54, the right-left sensor 55, and the turn sensor 56 may each include a potentiometer.

The vessel operation system 3 additionally includes a heading maintaining button 57 that is operationally pressed by the vessel operator in order to maintain the heading of the hull 2 while restraining the veering of the hull 2, and a fixed-point maintaining button 58 that is operationally pressed by the vessel operator in order to maintain the position of the hull 2 so as to be fixed at the present position. The heading maintaining button 57 and the fixed-point maintaining button 58 are each an example of the above-described second operator, and are each located at a position easily reached by vessel-operator's fingers in the operational platform 7, e.g., at a root of the joystick 10 (see FIG. 1). When the heading maintaining button 57 is operationally pressed, a signal to that effect is input into the BCU 5. This signal is an example of a second vessel operation command generated by the heading maintaining button 57. When the fixed-point maintaining button 58 is operationally pressed, a signal to that effect is input into the BCU 5. This signal is an example of a second vessel operation command generated by the fixed-point maintaining button 58.

In the steering vessel operation, a signal indicating the turning position (operation angle) of the steering wheel 8A is input into the left and right ECUs 6L and 6R as an example of a first vessel operation command generated by the steering operation portion 8. More specifically, each of the ECUs 6 sets a target value of the steering angle (which is hereinafter referred to as "target steering angle") in accordance with the turning position of the steering wheel 8A detected by the steering sensor 52. More specifically, each of the ECUs 6 sets a target steering angle for right-handed turning with respect to the turning operation of the steering wheel 8A in the rightward direction from the neutral position. Similarly, each of the ECUs 6 sets a target steering angle for left-handed turning with respect to the rotational operation of the steering wheel 8A in the leftward direction from the neutral position. In any case, the target steering angle is set so that its absolute value (deflection angle from the neutral position) becomes larger in proportion to an increase in the turning amount of the steering wheel 8A from the neutral position. Each of the ECUs 6 controls a corresponding one of the steering actuators 41 so that the steering angle detected by the steering angle sensor 43 coincides with the target steering angle. Ordinarily, the target steering angles of the left and right outboard motors 4L and 4R are set to be equal to each other.

In the steering vessel operation, a signal indicating the tilt position of the throttle lever 9L is input into the left ECU 6L, and a signal indicating the tilt position of the throttle lever 9R is input into the right ECU 6R. A signal indicating each of the tilt positions of the throttle levers 9L and 9R is an example of a first vessel operation command generated by the throttle operation portion 9.

More specifically, the left ECU 6L sets a shift position and a target value of the throttle opening degree for the left outboard motor 4L in accordance with a tilt position of the throttle lever 9L detected by the left sensor 53L. The target value of the shift position is hereinafter referred to as "target shift position," and the target value of the throttle opening degree is hereinafter referred to as "target throttle opening degree." The right ECU 6R sets a target shift position and a target throttle opening degree for the right outboard motor 4R in accordance with a tilt position of the throttle lever 9R detected by the right sensor 53R.

The tilt position of each of the throttle levers 9L and 9R includes a request value for the opening degree of the throttle valve 36. Each of the ECUs 6 sets a target throttle opening degree, i.e., sets a target value for the opening degree of the throttle valve 36 based on a request value that has been input. If the forward tilt amount of the throttle lever 9L is more than a value corresponding to the forward shift-in position, the left ECU 6L sets the target shift position of the left outboard motor 4L as a forward position. When the throttle lever 9L is further tilted forwardly beyond the forward shift-in position, the left ECU 6L sets a target throttle opening degree that becomes larger in proportion to an increase in the tilt amount. Similarly, if the rearward tilt amount of the throttle lever 9L is more than a value corresponding to the backward shift-in position, the left ECU 6L sets the target shift position of the left outboard motor 4L as a backward position. When the throttle lever 9L is further tilted rearwardly beyond the backward shift-in position, the left ECU 6L sets a target throttle opening degree that becomes larger in proportion to an increase in the tilt amount.

When the tilt position of the throttle lever 9L is between the forward shift-in position and the backward shift-in position, the left ECU 6L sets the target shift position of the left outboard motor 4L as a neutral position. At this time, the driving force of the engine 29 is not transmitted to the propeller 31, and therefore a thrust from the outboard motor 4 is not generated. In other words, an operational range between the forward shift-in position and the backward shift-in position is a dead zone that does not generate thrust, and the neutral position is included in the dead zone.

The right ECU 6R performs the same process with respect to the tilt position of the throttle lever 9R detected by the right sensor 53R. In other words, the right ECU 6R sets a target shift position and a target throttle opening degree of the right outboard motor 4R in accordance with the tilt position of the throttle lever 9R.

When the target shift position and the target throttle opening degree are set in this way, each of the ECUs 6 controls a corresponding one of the shift actuators 39 so that the slider 33D is located at the target shift position. Each of the ECUs 6 controls a corresponding one of the throttle actuators 37 so that the throttle opening degree detected by the throttle-opening-degree sensor 38 coincides with the target throttle opening degree.

In the joystick vessel operation, a signal that indicates a tilt position of the joystick 10 and a turning position of the knob 11 is input into the BCU 5 as an example of a second vessel operation command generated by the joystick 10. The BCU 5 provides data that shows a target shift position (forward, neutral, backward), a target throttle opening degree, and a target steering angle that are based on the second vessel operation command to each of the ECUs 6.

More specifically, the BCU 5 sets a target shift position and a target throttle opening degree in accordance with a tilt position of the joystick 10. The tilt position of the joystick 10 includes a request value concerning an opening degree of the throttle valve 36. The BCU 5 sets a target value concerning a target throttle opening degree, i.e., concerning an opening degree of the throttle valve 36 of each of the outboard motors 4 based on the request value that has been input.

More specifically, the BCU 5 sets the target shift position as the forward position if the forward tilt amount of the joystick 10 is larger than a value corresponding to the forward shift-in position. When the joystick 10 is further tilted forwardly beyond the forward shift-in position, the BCU 5 sets a larger target throttle opening degree in proportion to an increase in the tilt amount. Similarly, the BCU 5 sets the target shift position as the backward position if the rearward tilt amount of the joystick 10 is larger than a value corresponding to the backward shift-in position. When the joystick 10 is further tilted rearwardly beyond the backward shift-in position, the BCU 5 sets a larger target throttle opening degree in proportion to an increase in the tilt amount. The BCU 5 sets the target shift position as the neutral position when the tilt position in the front-rear direction of the joystick 10 is in the neutral position between the forward shift-in position and the backward shift-in position.

The BCU 5 sets a target steering angle in accordance with a turning position of the knob 11. More specifically, a target steering angle for right-handed turning is set with respect to the turning operation of the knob 11 in the rightward direction, and its absolute value (deflection angle from the neutral position) becomes larger in proportion to an increase in the turning amount from the neutral position. Similarly, a target steering angle for left-handed turning is set with respect to the turning operation of the knob 11 in the leftward direction, and its absolute value becomes larger in proportion to an increase in the turning amount from the neutral position.

In another operation example, the BCU 5 may set not only both a target shift position and a target throttle opening degree but also a target steering angle in accordance with the tilt in the diagonal leftward direction or in the diagonal rightward direction of the joystick 10. In that case, the BCU 5 sets a target steering angle for left-handed turning with respect to the tilt operation in the diagonal leftward direction of the joystick 10. Similarly, the BCU 5 sets a target steering angle for right-handed turning with respect to the tilt operation in the diagonal rightward direction of the joystick 10. In any case, the target steering angle is set so that its absolute value (deflection angle from the neutral position) becomes larger in proportion to an increase in the tilt amount of the joystick 10 from the neutral position.

The BCU 5 gives a target value (target shift position, target throttle opening degree, target steering angle), which has been set in this way, to the ECU 6 of each of the outboard motors 4. In the joystick vessel operation, ordinarily, target values of the left and right outboard motors 4L and 4R are set to be equal to each other. Each of the ECUs 6 controls a corresponding one of the shift actuators 39 so that the slider 33D is located at the target shift position. Each of the ECUs 6 controls a corresponding one of the throttle actuators 37 so that the throttle opening degree detected by the throttle-opening-degree sensor 38 coincides with the target throttle opening degree. Each of the ECUs 6 controls a corresponding one of the steering actuators 41 so that the steering angle detected by the steering angle sensor 43 coincides with the target steering angle.

The BCU 5 may set the target shift position, the target throttle opening degree, and the target steering angle in accordance with the operation in the left-right direction of the joystick 10 (operation in the exactly lateral direction). In that case, with respect to the tilt operation in the leftward direction of the joystick 10, the BCU 5 sets the target shift position, the target throttle opening degree, and the target steering angle for a leftward rectilinear movement without veering around the resistant center P. This rectilinear movement is referred to as "translational movement." With respect to the tilt operation in the rightward direction of the joystick 10, the BCU 5 sets the target shift position, the target throttle opening degree, and the target steering angle for a rightward translational movement. In the translational movement, the target shift position of the left outboard motor 4L and the target shift position of the right outboard motor 4R are set to be mutually opposite. The target throttle opening degree of the left outboard motor 4L and the target throttle opening degree of the right outboard motor 4R are set to be mutually the same. The BCU 5 sets a larger target throttle opening degree in proportion to an increase in the tilt amount of the joystick 10 from the neutral position. The absolute value of the target steering angle is set to be the same in the left outboard motor 4L and in the right outboard motor 4R, and yet the turning direction of the left outboard motor 4L and the turning direction of the right outboard motor 4R are set to be mutually opposite. This will be described in detail below.

Hereinafter, a combination of the BCU 5 and the ECUs 6 is referred to as a controller 60, and each of the BCU 5 and the ECUs 6 is regarded as any one of a plurality of functional processing portions of the controller 60.

Next, various vessel operation patterns by the vessel operator will be described. FIG. 4 to FIG. 9 are schematic plan views to describe the behavior of the vessel 1 by a vessel operation of each pattern.

Figure 4:
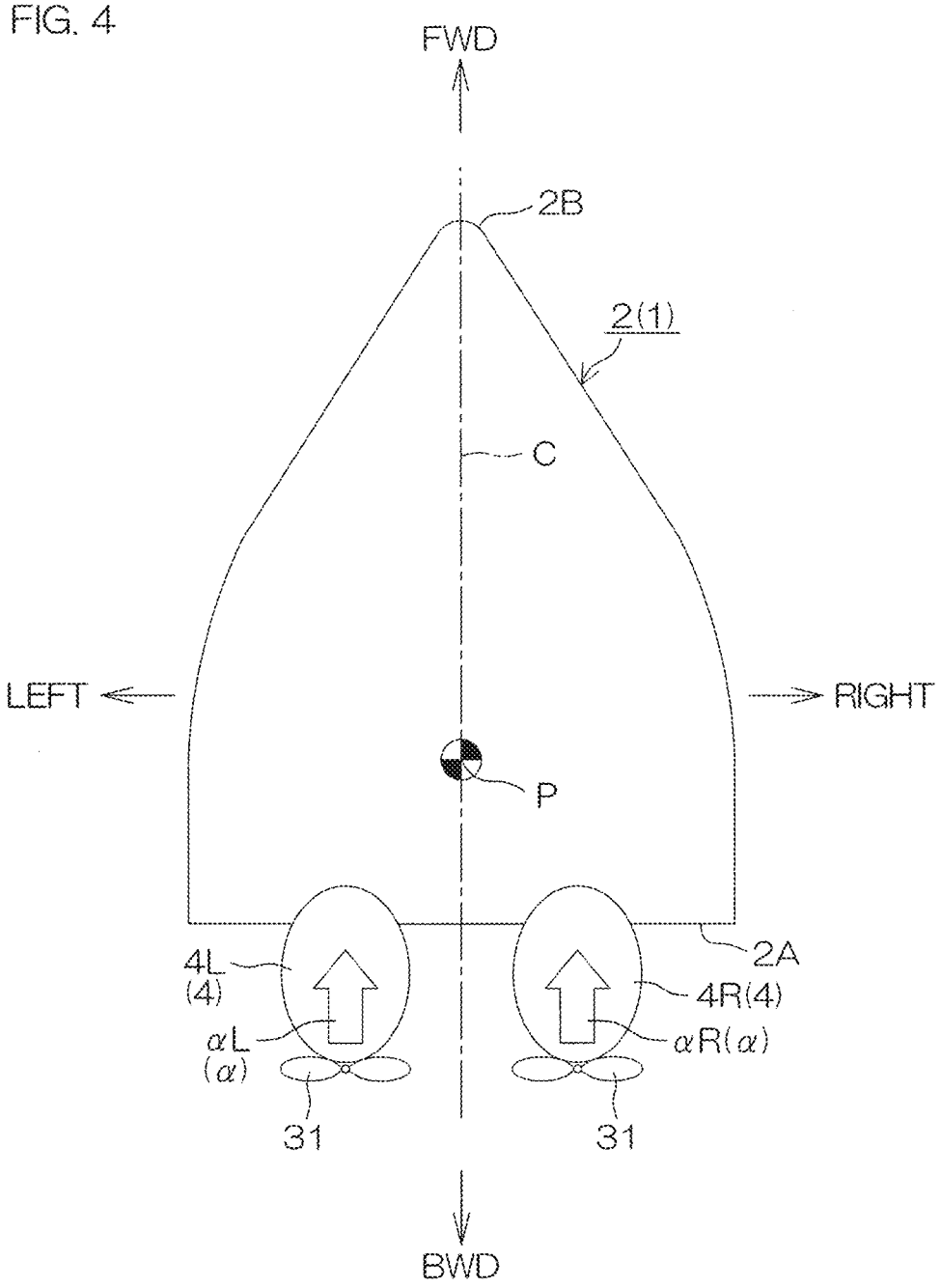
FIG. 4 is a plan view to describe a first behavior of the vessel by a vessel operation.

The vessel operator simultaneously turns both of the throttle levers 9L and 9R to a more forward position than the forward shift-in position in a state in which the steering wheel 8A is kept in the neutral position in the steering vessel operation. Thereupon, the controller 60 sets the target steering angle at zero, and sets the target throttle opening degree according to the tilt position of the throttle levers 9L and 9R, and therefore each of the outboard motors 4 generates a forward equal thrust $\alpha$ along the center line C of the hull 2 as shown in FIG. 4. Thus, the vessel 1 travels straight forwardly. The thrust $\alpha$ generated by the left outboard motor 4L is hereinafter referred to as "left thrust $\alpha$L," and the thrust $\alpha$ generated by the right outboard motor 4R is hereinafter referred to as "right thrust $\alpha$R."

Figure 5:
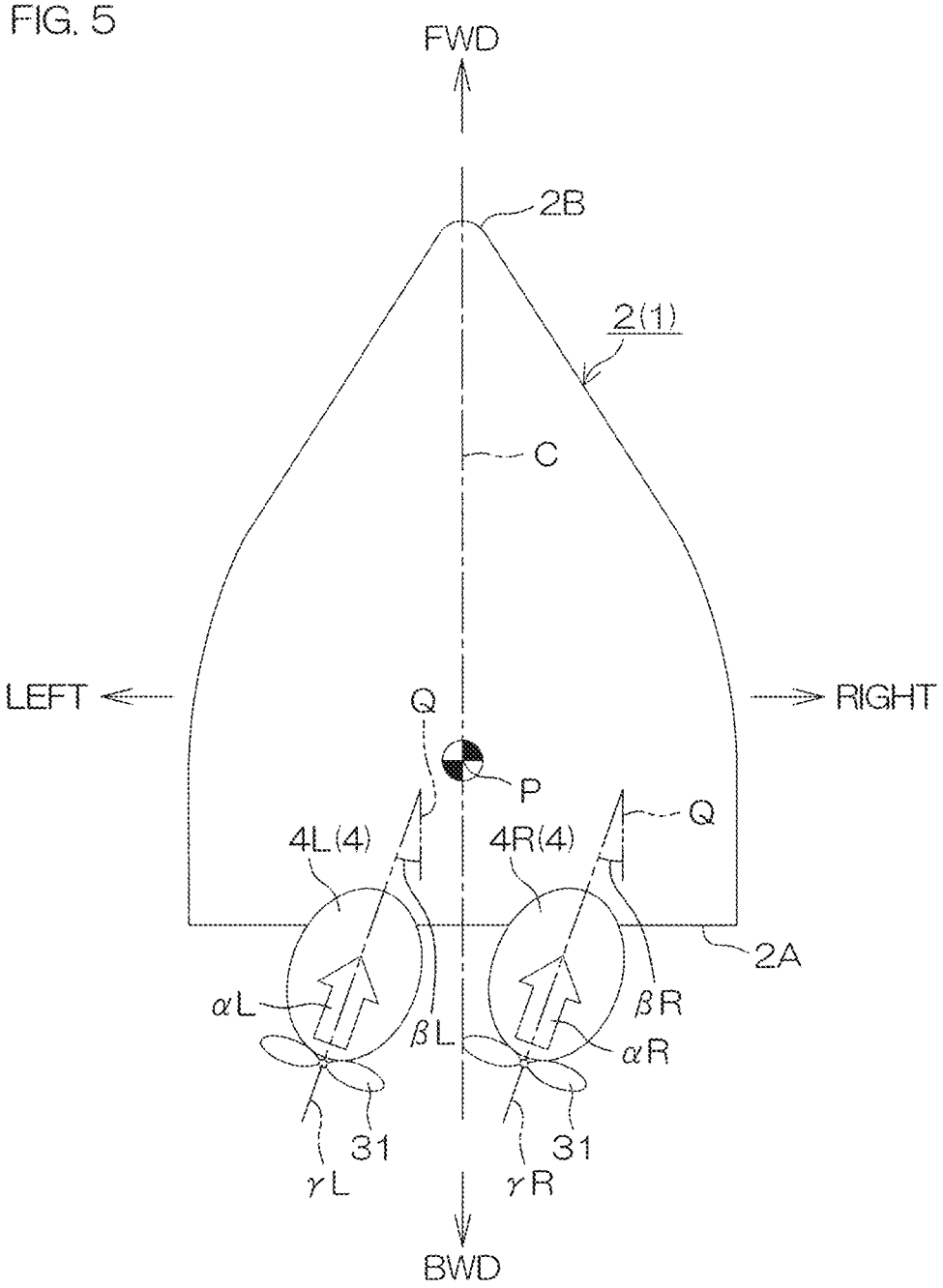
FIG. 5 is a plan view to describe a second behavior of the vessel by a vessel operation.

Referring to FIG. 5, the steering angle $\beta$ of each of the outboard motors 4 is a deflection angle of a rotational axis of the propeller 31 of each of the outboard motors 4 with respect to the center line C of the hull 2 or with respect to a phantom line Q parallel to the center line C. The rotational axis of the propeller 31 coincides with an acting line $\gamma$ of a thrust $\alpha$ generated by the outboard motor 4 in a plan view. In the following description, the steering angle $\beta$ of the left outboard motor 4L is referred to as the "left steering angle $\beta$L," and the steering angle $\beta$ of the right outboard motor 4R is referred to as the "right steering angle $\beta$R." Additionally, the acting line $\gamma$ of the left thrust $\alpha$L is referred to as the "left acting line $\gamma$L," and the acting line $\gamma$ of the right thrust $\alpha$R is referred to as the "right acting line $\gamma$R."

In the present preferred embodiment, the steering angle $\beta$ is set at 0 degrees when the acting line $\gamma$ is parallel to the center line C and to the phantom line Q in a plan view, and, as an example, the steering angle $\beta$ is set at a positive value when this angle increases leftwardly, whereas the steering angle $\beta$ is set at a negative value when this angle increases rightwardly. The upper limit value of the steering angle $\beta$ in a range in which each of the outboard motors 4 is physically turnable is referred to as a "turnable angle." The absolute value of the turnable angle in the present preferred embodiment is about 45 degrees as an example.

In a state (see FIG. 4) in which the vessel 1 is traveling straight forwardly, the vessel operator turns the steering wheel 8A leftwardly from the neutral position in the steering vessel operation in a state in which both of the throttle levers 9L and 9R have been tilted forwardly. Thereupon, the controller 60 sets a target throttle opening degree according to the tilt position of the throttle levers 9L and 9R, and sets a target steering angle for left-handed turning according to the turning position of the steering wheel 8A. Each of the target steering angles of the left and right outboard motors 4L and 4R in this case is an equal, positive value. Thus, each of the outboard motors 4 generates an equal, right-forward thrust $\alpha$. Thus, the vessel 1 turns in the leftward direction.

The controller 60 changes the maximum value of the steering angle $\beta$ of each of the outboard motors 4 while controlling the steering actuator 41 of each of the outboard motors 4, i.e., controlling the steering 42.

As an example, the controller 60 changes the maximum value of the steering angle $\beta$ in accordance with a traveling speed detected by the traveling speed sensor 50A. More specifically, the controller 60 sets a maximum value concerning the absolute value of the steering angle $\beta$ at a first set value when the traveling speed detected by the traveling speed sensor 50A is equal to or more than a predetermined threshold value. On the other hand, the controller 60 sets a maximum value concerning the absolute value of the steering angle $\beta$ at a second set value larger than the first set value when the traveling speed detected by the traveling speed sensor 50A is less than the predetermined threshold value.

An example of the threshold value is a traveling speed (about 20 km to about 30 km per hour) when the vessel 1 starts to plane.

As another example, the traveling speed in the previous example may be replaced with a pseudo traveling speed corresponding to the traveling speed subjected to a smoothing filter process 60F (see FIG. 3) such as a low pass filtering.

As a further example, the controller 60 changes the maximum value of the steering angle β in accordance with an engine rotational speed detected by the engine rotational speed sensor 50B. More specifically, the controller 60 sets a maximum value concerning the absolute value of the steering angle β at a first set value when the engine rotational speed detected by the engine rotational speed sensor 50B is equal to or more than a predetermined threshold value. On the other hand, the controller 60 sets a maximum value concerning the absolute value of the steering angle β at a second set value larger than the first set value when the engine rotational speed detected by the engine rotational speed sensor 50B is less than the predetermined threshold value.

An example of the threshold value is an engine rotational speed (an engine rotational speed when the traveling speed is about 20 km to about 30 km per hour, for example) when the vessel 1 starts to plane.

As a further example, the controller 60 changes the maximum value of the steering angle β in accordance with a pseudo engine rotational speed corresponding to the engine rotational speed detected by the engine rotational speed sensor 50B subjected to a smoothing filter process 60F (see FIG. 3) such as a low pass filtering. More specifically, the controller 60 sets a maximum value concerning the absolute value of the steering angle β at a first set value when the pseudo engine rotational speed is equal to or more than a predetermined threshold value. On the other hand, the controller 60 sets a maximum value concerning the absolute value of the steering angle β at a second set value larger than the first set value when the pseudo engine rotational speed is less than the predetermined threshold value.

An example of the threshold value is a pseudo engine rotational speed (a pseudo engine rotational speed when the traveling speed is about 20 km to about 30 km per hour, for example) when the vessel 1 starts to plane.

An example of the first set value is about 20 degrees. An example of the second set value is about 30 degrees or more, and, in the present preferred embodiment, is about 45 degrees, which is equal to the turnable angle of each of the outboard motors 4. The threshold value, the first set value, and the second set value are stored in the controller 60 (for example, in the memory of the BCU 5 or of the ECU 6).

The traveling speed, the pseudo traveling speed, the engine rotational speed, and the pseudo engine rotational speed are hereinafter collectively referred to as "speed data".

When the speed data is an intermediate speed or a high speed that is more than the threshold value, the controller 60 limits the maximum value of the steering angle β of each of the outboard motors 4 to the first set value as shown in FIG. 5. Therefore, the maximum value of the steering angle β of the outboard motor 4 does not exceed the first set value even if the vessel operator leftwardly or rightwardly turns the steering wheel 8A to its maximum.

Figure 6:
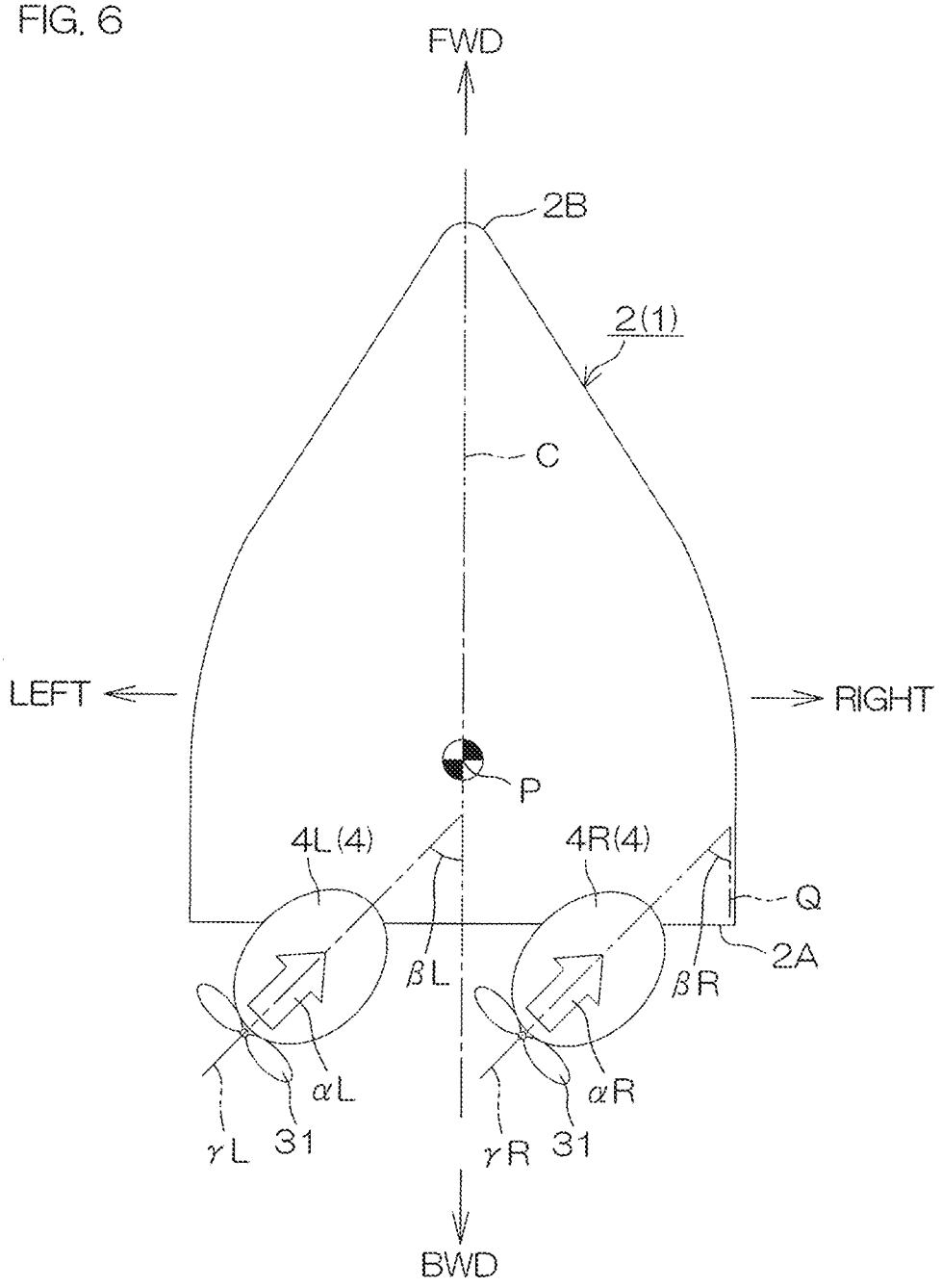
FIG. 6 is a plan view to describe a third behavior of the vessel by a vessel operation.

On the other hand, when the speed data is a low speed that is less than the threshold value, the controller 60 sets the maximum value of the steering angle β of each of the outboard motors 4 at the second set value that is larger than when traveling at the intermediate speed or at the high speed. Therefore, it is possible to increase the steering angle β of the outboard motor 4 up to the second set value larger than the first set value as shown in FIG. 6 if the vessel operator leftwardly or rightwardly turns the steering wheel 8A to its maximum. This makes it possible to reduce the turning radius of the vessel 1 and to move the vessel 1 in a behavior close to in-situ veering.

As another example, the controller 60 may change the maximum value of the steering angle β in accordance with a first vessel operation command issued by at least either one of the steering operation portion 8 and the throttle operation portion 9 and in accordance with a second vessel operation command issued by the joystick 10. In that case, the controller 60 may control the steering 42 within the maximum steering angle of the above-described first set value in response to the first vessel operation command, and may control the steering 42 within the maximum steering angle of the above-described second set value in response to the second vessel operation command.

More specifically, when the vessel operator performs the steering vessel operation, only the first vessel operation command is input into the controller 60, and therefore the controller 60 limits the maximum value of the steering angle β of each of the outboard motors 4 to the first set value. Therefore, the maximum value of the steering angle β of the outboard motor 4 does not exceed the first set value even if the vessel operator leftwardly or rightwardly turns the steering wheel 8A to its maximum (see FIG. 5). On the other hand, when the vessel operator performs the joystick vessel operation, only the second vessel operation command is input into the controller 60, and therefore the controller 60 sets the maximum value of the steering angle β of each of the outboard motors 4 at the second set value larger than when performing the steering vessel operation (see FIG. 6).

The vessel operation of laterally moving the hull 2 in a direction (for example, leftward) including a right-left direction component will be hereinafter described with reference to FIG. 7 to FIG. 9.

A first vessel operation command or a second vessel operation command, which is a vessel operation request by the vessel operator, is input into the controller 60 when the vessel operator operates any one of the steering wheel 8A, the throttle levers 9L, 9R, and the joystick 10. When the first vessel operation command is input, the controller 60 (strictly, each of the ECUs 6) determines an outboard motor target value, which is a target value (target shift position, target throttle opening degree, and target steering angle) of the outboard motor 4 for the steering vessel operation, and drives the outboard motor 4 in accordance with this outboard motor target value.

Figure 7:
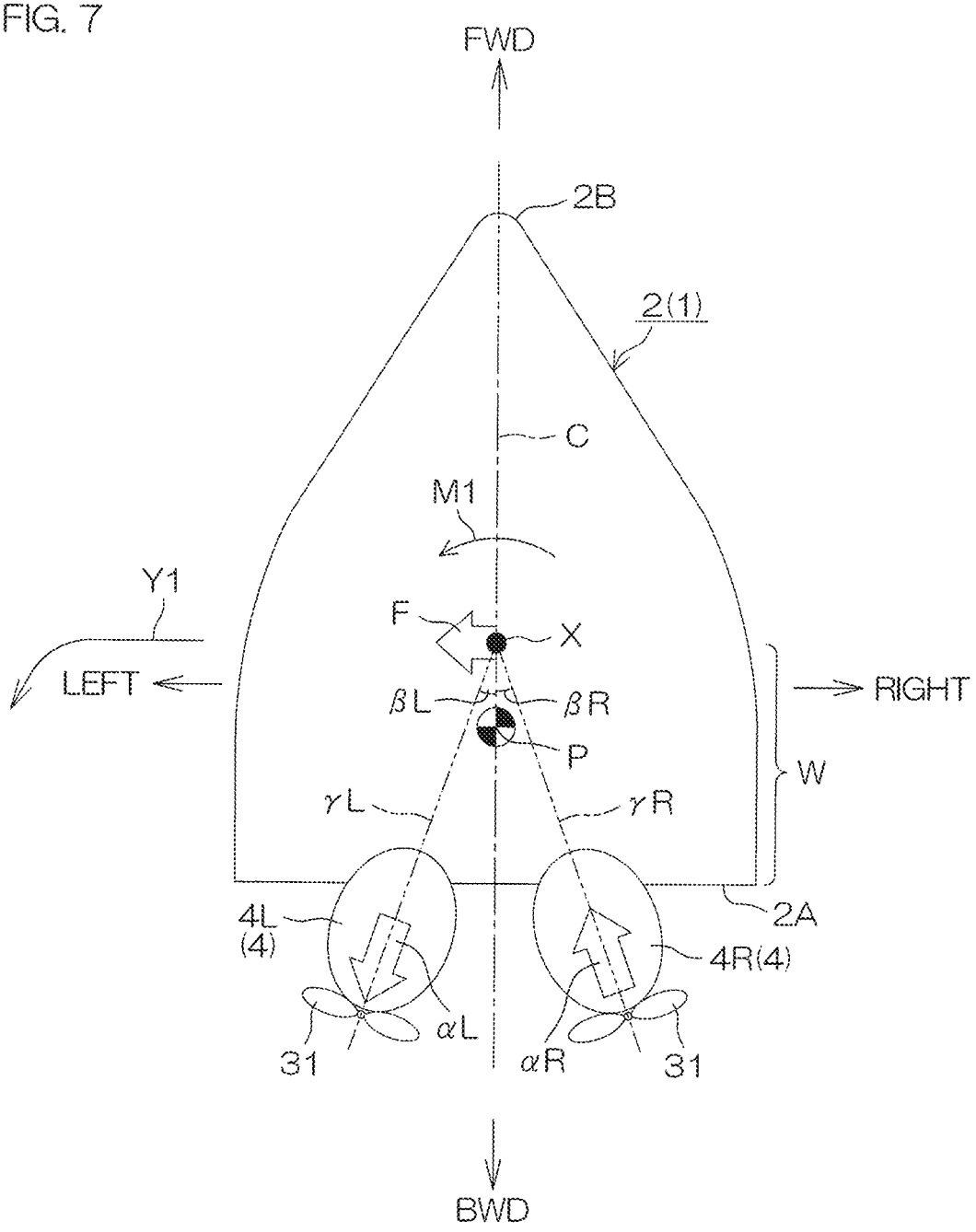
FIG. 7 is a plan view to describe a fourth behavior of the vessel by a vessel operation.

Referring to FIG. 7, when the hull 2 is leftwardly moved, the controller 60 leftwardly turns the left outboard motor 4L, and rightwardly turns the right outboard motor 4R until the absolute value of the steering angle β of each of the outboard motors 4 reaches a maximum value. The absolute value of a left steering angle βL and the absolute value of a right steering angle βR are equal to each other. Thereafter, the controller 60 allows the left outboard motor 4L to generate a left thrust αL in the backward direction, and allows the right outboard motor 4R to generate a right thrust αR in the forward direction. Thus, a resultant force of the left and right thrusts αL and αR acts on the hull 2 as a leftward thrust F at an intersection position X between left and right acting lines γL and γR on the center line C.

It should be noted that the maximum value of the steering angle β in the steering vessel operation is the first set value, and is a small value of about 20 degrees in the present preferred embodiment, and therefore the intersection position X is disproportionately located at a more forward position than the resistant center P of the hull 2 even if the steering angle β is any value. In this case, a yawing moment (hereinafter, referred to as "moment") M1, which is anti-clockwise in a plan view, is generated by the leftward thrust F, and therefore the vessel 1 is urged to leftwardly move while being accompanied by left-backward veering as shown by the arrow Y1.

On the other hand, let it be supposed that the vessel operation request that has been input into the controller 60 is the second vessel operation command, and, for example, the vessel operator leftwardly tilts the joystick 10. In this case, a signal indicating a leftward tilt position of the joystick 10 detected by the right-left sensor 55 is input into the controller 60 as the second vessel operation command. Thereupon, the controller 60 determines a hull target value that is a target value of a thrust F that is to act on the hull 2. Thereafter, the controller 60 determines an outboard-motor target value of each of the outboard motors 4 in accordance with this hull target value, and drives a corresponding one of the outboard motors 4 in accordance with the outboard-motor target value. Thus, the hull 2 is leftwardly moved by the thrust of each of the outboard motors 4.

In the joystick vessel operation, the controller 60 changes the absolute value of the steering angle β of each of the outboard motors 4 within the second set value so as to reach a value according to the tilt amount of the joystick 10. Therefore, when the hull 2 is leftwardly moved, the controller 60 leftwardly turns the left outboard motor 4L, and rightwardly turns the right outboard motor 4R. The absolute value of the left steering angle βL and the absolute value of the right steering angle βR are equal to each other. Thereafter, the controller 60 allows the left outboard motor 4L to generate a left thrust αL in the backward direction, and allows the right outboard motor 4R to generate a right thrust αR in the forward direction. Therefore, also in the joystick vessel operation, a resultant force of the left and right thrusts αL and αR acts on the hull 2 as a leftward thrust F in the intersection position X between the left and right acting lines γL and γR on the center line C in the same way as in the steering vessel operation.

The second set value in the joystick vessel operation is larger than the first set value, and is 45 degrees in the present preferred embodiment. Therefore, if the steering angle β of each of the outboard motors 4 according to the tilt amount of the joystick 10 is small, the intersection position X is disproportionately located at a more forward position than the resistant center P of the hull 2, and therefore it is possible to leftwardly move the vessel 1 while being accompanied by left-backward veering as shown by the arrow Y1 of FIG. 7.

Figure 8:
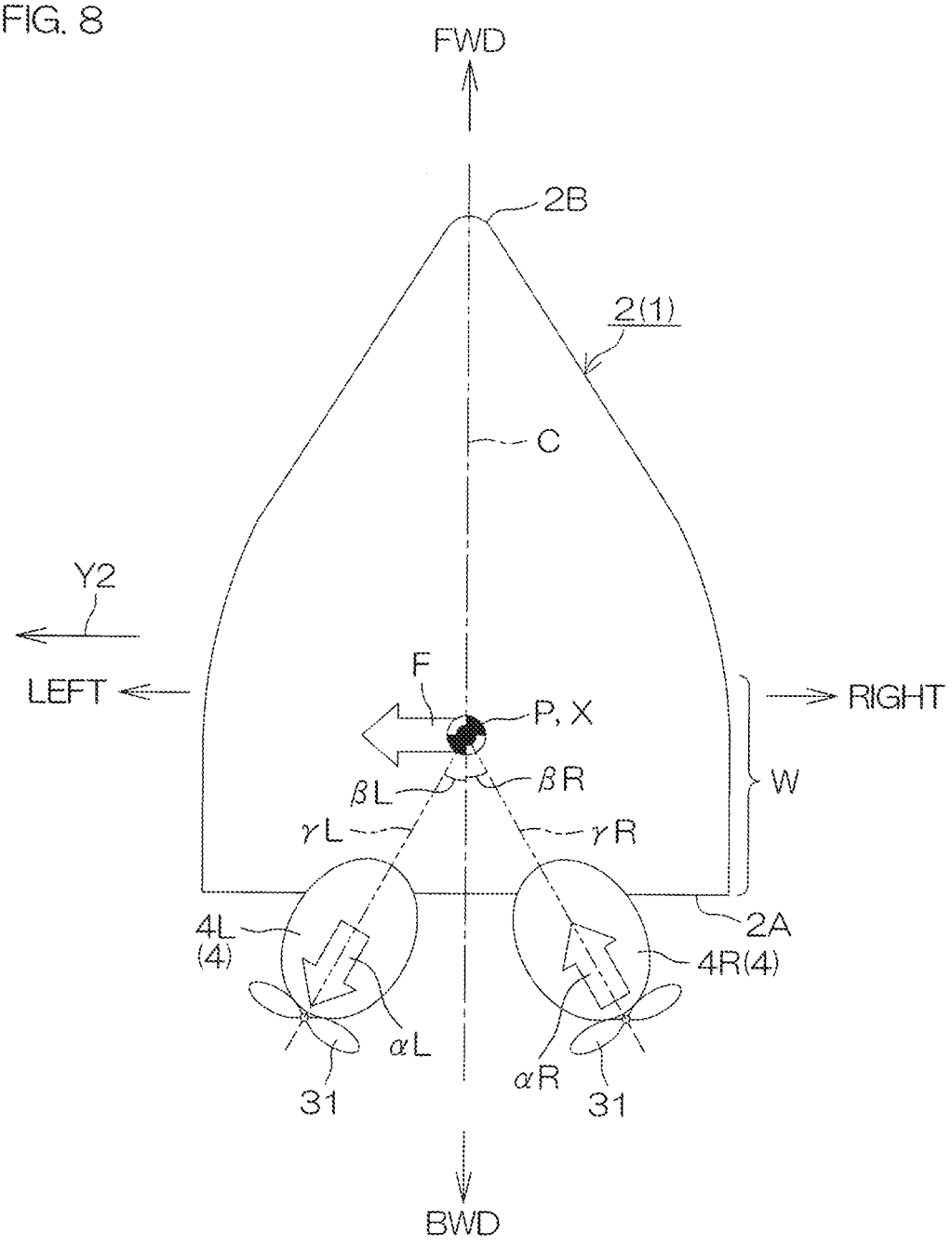
FIG. 8 is a plan view to describe a fifth behavior of the vessel by a vessel operation.

Thereafter, when the steering angle β of each of the outboard motors 4 becomes larger beyond the first set value in proportion to an increase in the leftward tilt amount of the joystick 10, the intersection position X coincides with the resistant center P of the hull 2 as shown in FIG. 8. Thereupon, the vessel 1 is enabled to leftwardly make a translational movement without being accompanied by veering as shown by the arrow Y2 because all moments including the above-described moment M1 are not generated. The right-left-direction component in the thrust α of each of the outboard motors 4 at this time is larger than when the intersection position X is located at a more forward position than the resistant center P of the hull 2 (see FIG. 7), and therefore the leftward thrust F acting on the hull 2 also becomes larger.

Figure 9:
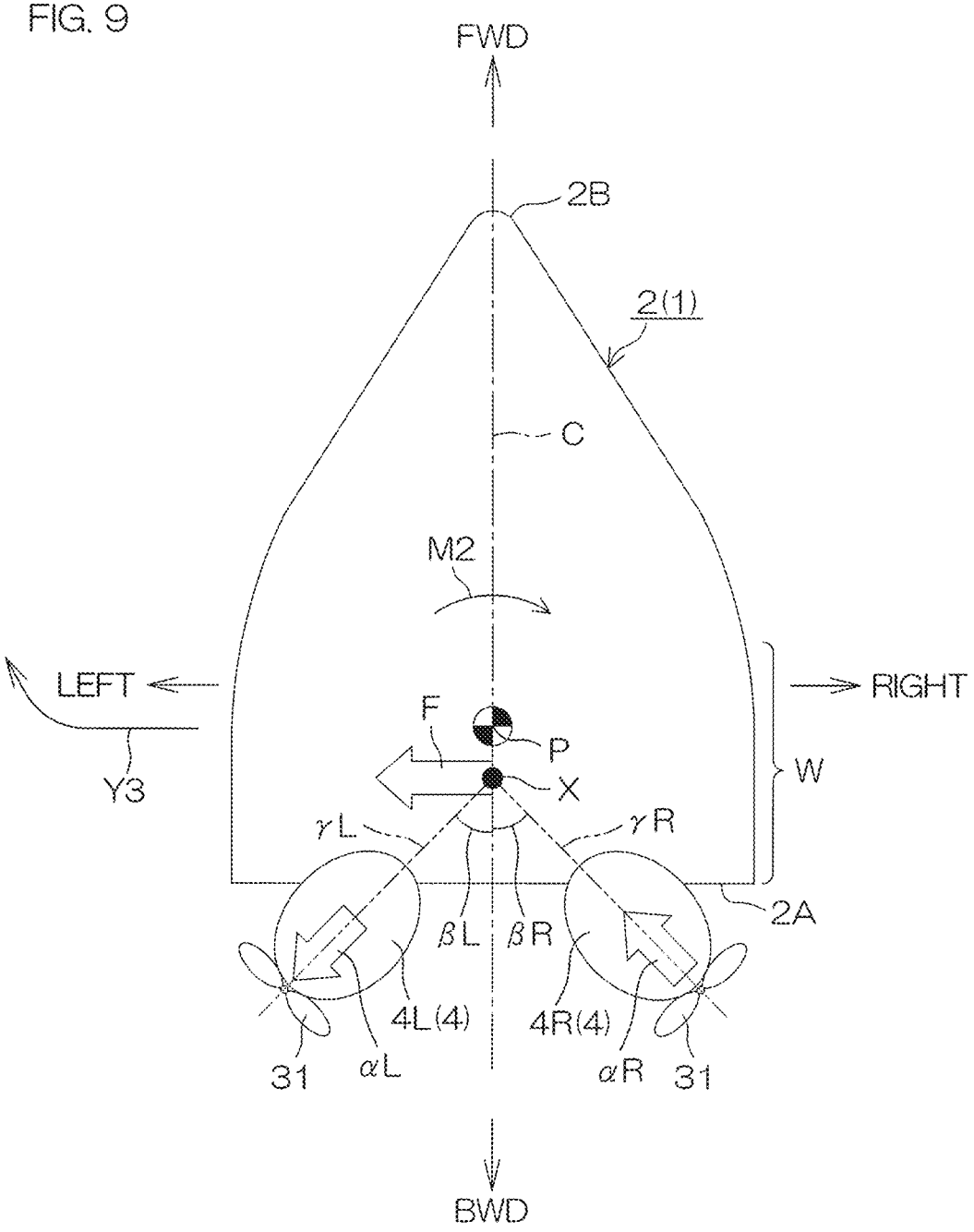
FIG. 9 is a plan view to describe a sixth behavior of the vessel by a vessel operation.

When the steering angle β of each of the outboard motors 4 becomes even larger in proportion to an increase in the leftward tilt amount of the joystick 10 and reaches the second set value, the intersection position X is located at a more rearward position than the resistant center P of the hull 2 as shown in FIG. 9. Thereupon, a moment M2, which is clockwise in a plan view, is generated by the leftward thrust F, and therefore the vessel 1 is urged to leftwardly move while being accompanied by left-forward veering as shown by the arrow Y3. The right-left direction component in the thrust α of each of the outboard motors 4 at this time is larger than when the intersection position X coincides with the resistant center P of the hull 2 (see FIG. 8), and therefore the leftward thrust F acting on the hull 2 also becomes larger.

As described above, the second set value is determined so that the intersection position X between the acting lines γ of thrusts α generated by the plurality of outboard motors 4 is changeable in a range W including the resistant center P, a more forward position than the resistant center P, and a more rearward position than the resistant center P. The rear end of the range W is the stern 2A.

When the vessel operator operationally presses the heading maintaining button 57 and the fixed-point maintaining button 58, a maintenance command corresponding to these operations is input into the controller 60. When the maintenance command is input, the controller 60 calculates a target value. More specifically, the controller 60 calculates a momentary amount of change in position of the vessel 1 based on a present-position signal of the vessel 1 generated by the position detector 51, and, from this amount of change, the controller 60 calculates an external force generated by waves and the like acting on the vessel 1. Thereafter, the controller 60 calculates a target value of a thrust α and a target value of a steering angle β that are to be generated by each of the outboard motors 4 so that a resultant force balancing with the external force calculated above is generated. In that case, the controller 60 sets the maximum value of the steering angle β at the above-described second set value. Thereafter, the controller 60 drives each of the outboard motors 4 so as to generate a thrust α having that target value, and controls the steering 42 within the maximum steering angle of the second set value. Thus, the heading or the position of the vessel 1 is maintained by the thrust α generated by each of the outboard motors 4.

The vessel 1 may be provided with only one outboard motor 4. In this case, the single outboard motor 4 is attached to a central portion in the left-right direction in the stern 2A of the hull 2, and the throttle operation portion 9 of the vessel 1 is provided with only one throttle lever, and only one ECU 6 is provided. In the vessel 1 provided with only one outboard motor 4, it is possible to achieve a behavior even closer to in-situ veering than the vessel 1 provided with a plurality of outboard motors 4 by setting the maximum value of the steering angle β at the second set value.

As described above, in the vessel 1 including the vessel operation system 3, the maximum value of the steering angle β changes in accordance with the situation. This makes it possible to provide a vessel having a more excellent vessel operation feeling than a vessel including a conventional vessel operation system in which the maximum value of the steering angle β is fixed.

Figure 10:
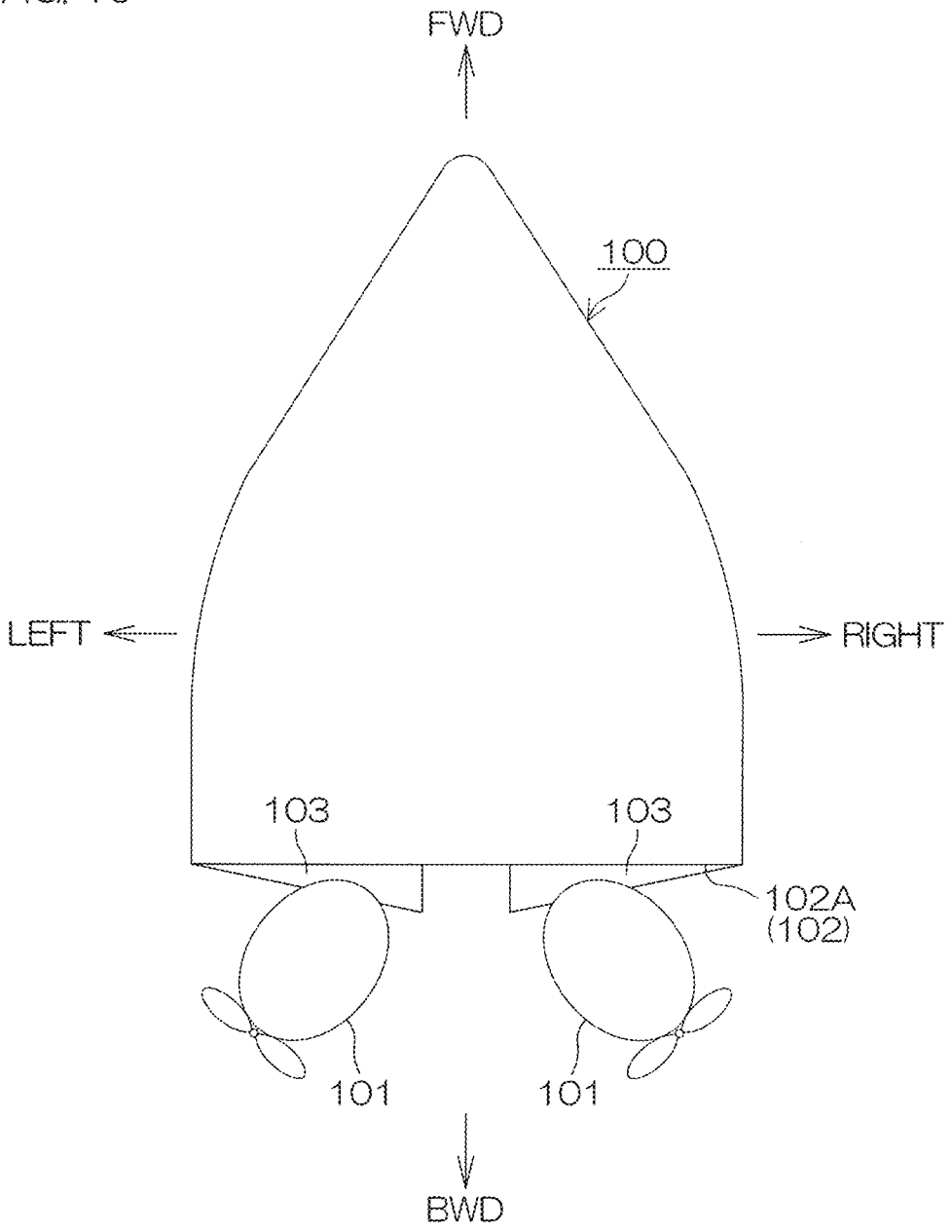
FIG. 10 is a conceptual diagram to describe an arrangement of a vessel according to a comparative example.

As an example, the controller 60 of the vessel operation system 3 changes the maximum value of the steering angle β in accordance with the speed data while controlling the steering 42. With this structural arrangement, the maximum value of the steering angle β changes in accordance with the speed data. Therefore, it is possible to achieve a more excellent operation feeling than the conventional vessel operation system in which the maximum value of the steering angle is fixed. Additionally, if the maximum value of the steering angle β is changeable, it is possible to omit a wedged attachment 103 that is attached to a stern 102A of a hull 102 to direct an outboard motor 101 outwardly in the left-right direction in order to secure a large steering angle as in a vessel 100 of a comparative example (see FIG. 10).

In a preferred embodiment of the present invention, the maximum value of the steering angle β is set at the first set value when the speed data is more than the threshold value, and, on the other hand, the maximum value of the steering angle β is set at the second set value larger than the first set value when the speed data is comparatively low and is less than the threshold value. Therefore, it is possible to enlarge a right-left direction component of the thrust α by a large steering angle β when traveling at a low speed. This makes it possible to obtain a large thrust component in the left-right direction when traveling at a low speed, thus making it possible to improve a vessel operation feeling.

In a preferred embodiment of the present invention, the maximum value of the steering angle β may be set at the first set value and at the second set value in accordance with the operation of the steering operation portion 8 and the operation of the joystick 10, respectively, by the vessel operator. Therefore, it is possible to appropriately set the maximum value of the steering angle β in accordance with these operators.

For example, the steering operation portion 8 may be suitable for a vessel operation during high-speed traveling, and the joystick 10 may be suitable for a vessel operation during low-speed traveling. When the joystick 10 is operated to move the vessel 1 in the left-right direction during low-speed traveling, the maximum value of the steering angle β is set at the second set value larger than the first set value. This makes it possible to obtain a large thrust in the left-right direction because a thrust α generated by the outboard motor 4 when the steering angle β increases beyond the first set value has a large right-left direction component (see FIG. 6, FIG. 8, and FIG. 9). This makes it possible to achieve excellent vessel operation responsibility, thus making it possible to improve a vessel operation feeling.

In a preferred embodiment of the present invention, the second set value is determined so that the intersection position X between the acting lines γ of thrusts α generated by the plurality of outboard motors 4 is changeable in a range W including the resistant center P of the hull 2, a more forward position than the resistant center P, and a more rearward position than the resistant center P.

This structural arrangement enables the intersection position X between the acting lines γ of thrusts α generated by the plurality of outboard motors 4 to be located at forward and rearward positions with respect to the resistant center P of the hull 2 and to coincide with the resistant center P (see FIG. 7 to FIG. 9). Thus, it becomes possible to freely control veering and translational movement of the hull 2, and therefore the vessel 1 is moved in various behaviors. This makes it possible to improve a vessel operation feeling.

In a preferred embodiment of the present invention, the second set value concerning the maximum value of the steering angle β is equal to the turnable angle of the outboard motor 4. Thus, it is possible to turn the outboard motor 4 up to the turnable angle when the second set value is applied, and therefore it is possible to use the maximum right-left direction component of a thrust α generated by the outboard motor 4. This makes it possible to obtain a sufficient thrust in the left-right direction, thus making it possible to improve a vessel operation feeling.

Figure 11:
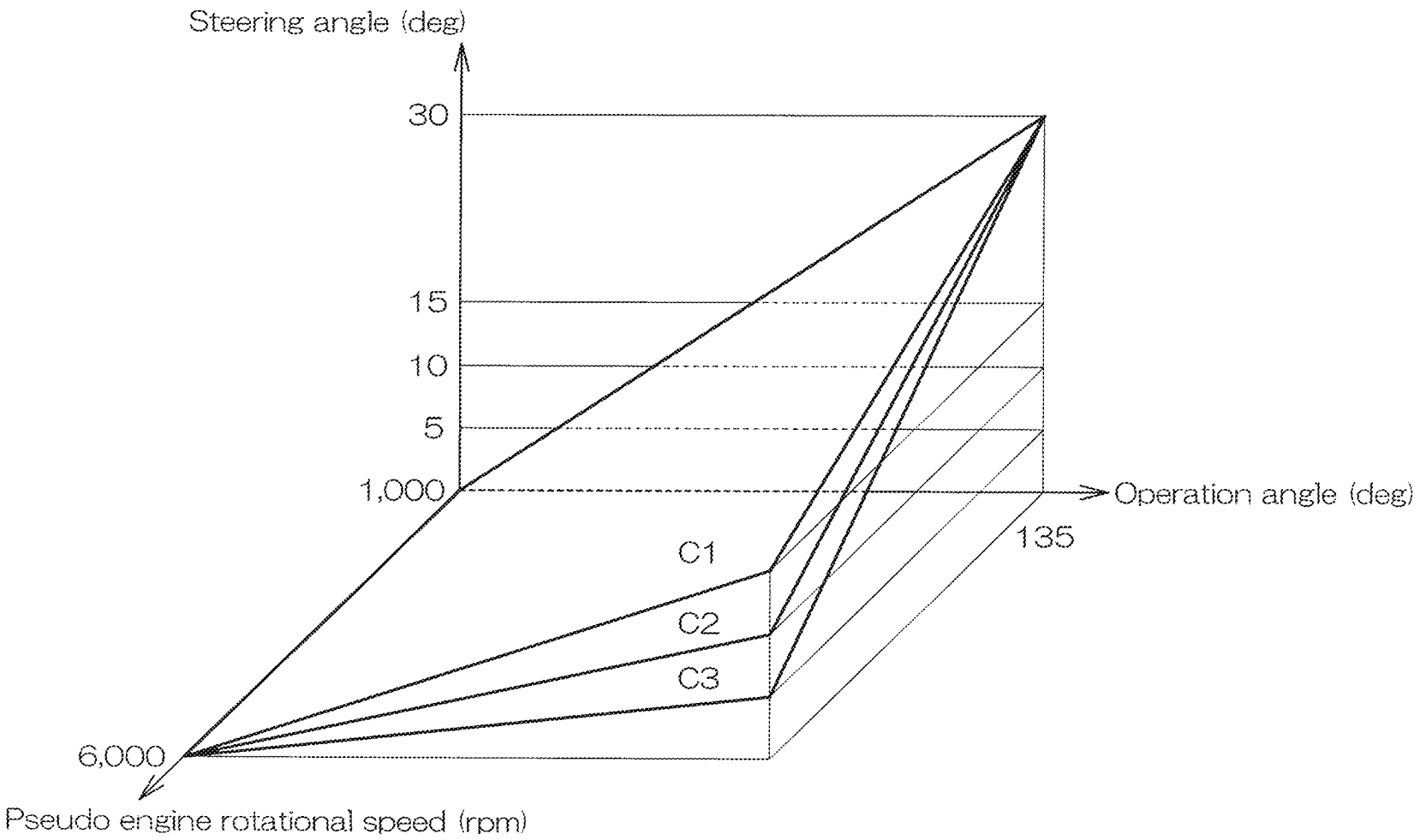
FIG. 11 shows examples of three-dimensional maps that define a steering angle (target steering angle) with respect to an operation angle of a steering wheel and speed data.

FIG. 11 is a graph to describe a more specific example of the control process performed by the controller 60. FIG. 11 shows three-dimensional maps that define a steering angle β (target steering angle) with respect to the operation angle of the steering wheel 8A and the pseudo engine rotational speed. Each of the three-dimensional maps defines a three-dimensional curved surface which defines the relationship among the operation angle, the pseudo engine rotational speed, and the steering angle β. The three-dimensional curved surface is defined such that the larger the operational angle is, the larger the steering angle β is, and such that the larger the pseudo engine rotational speed is, the smaller the steering angle β is. The steering wheel 8A may be rotatable or turnable to a certain maximum operation angle (about 135 degrees, for example) to the left and right. In other words, the operation angle range of the steering wheel 8A may be restricted. The steering angle β takes its maximum value when the operation angle is the maximum value thereof. The maximum value of the steering angle β becomes larger as the pseudo engine rotational speed becomes smaller. In other words, the maximum value of the steering angle β becomes smaller as the pseudo engine rotational speed becomes larger.

FIG. 11 shows three of the three-dimensional curved surfaces that define different characteristics. For example, the three-dimensional curved surface C1 may be applicable to a low speed vessel, the three-dimensional curved surface C2 may be applicable a middle speed vessel, and the three-dimensional curved surface C3 may be applicable to a high speed vessel.

Figure 12:
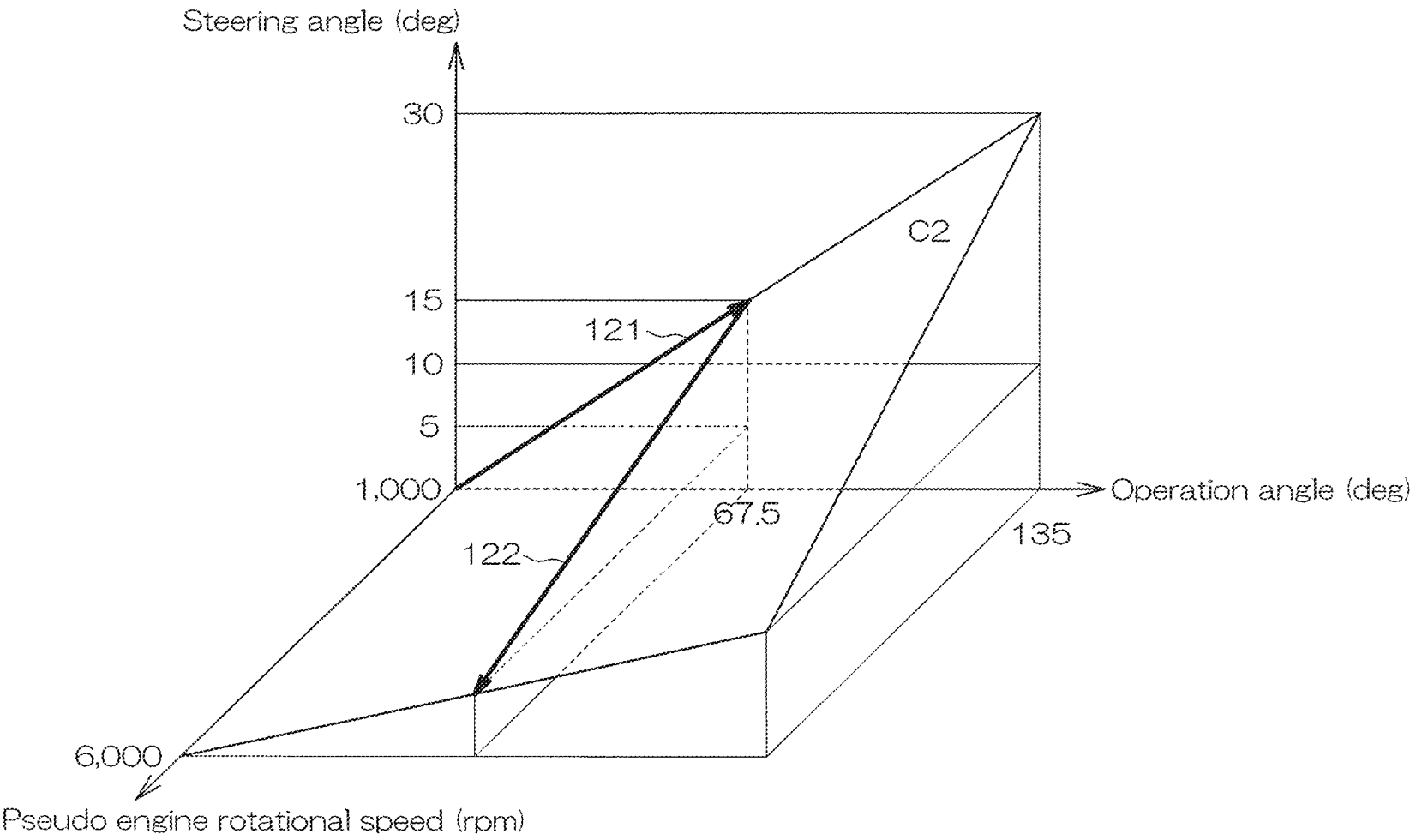
FIG. 12 shows a graph to describe the change of the steering angle in accordance with the change of an engine rotational speed.

By controlling the steering 42 in accordance with the three-dimensional map, the steering angle β of the outboard motor 4 changes depending on the pseudo engine rotational speed even when the operation angle of the steering wheel 8A is kept constant. For example, in the example shown in FIG. 12, it is assumed that the steering wheel 8A is operated when the pseudo engine rotational speed is 0 rpm, resulting in the steering angle β of 15 degrees (see reference numeral 121). Thereafter, the operator operates the throttle lever 9 to increase the engine rotational speed without changing the operation angle of the steering wheel 8A and, accordingly, the pseudo engine rotational speed increases to 6000 rpm. In this case, the steering angle β gradually decreases to 5 degrees (see reference numeral 122). In this manner, the steering angle β changes in accordance with the pseudo engine rotational speed (an example of the speed data), thus realizing a natural operational feeling suited to the speed of the vessel 1.

Figure 13:
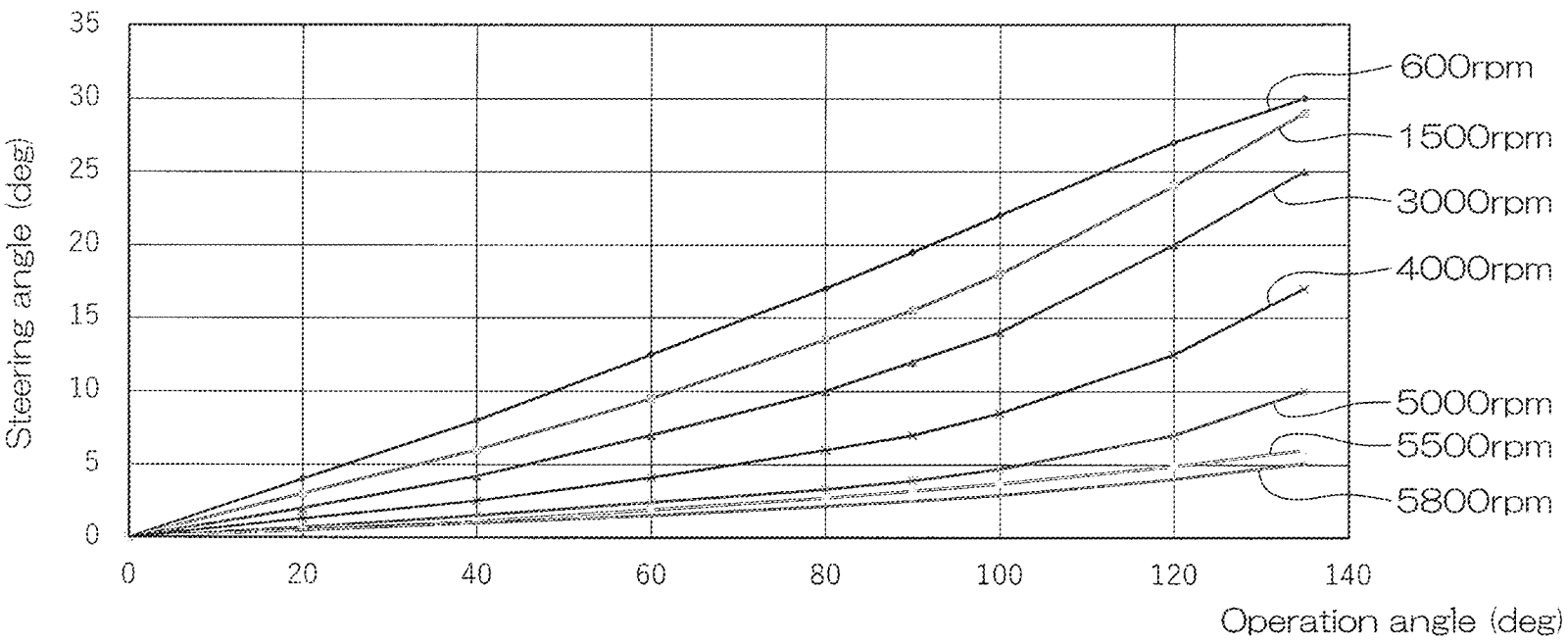
FIGS. 13, 14, and 15 show examples of a two-dimensional expression of the three-dimensional maps.

FIG. 13 shows an example of a two-dimensional expression of a three-dimensional map corresponding to one of the three-dimensional curved surfaces, for example, the three-dimensional curved surface C2. The abscissa indicates the operation angle (degree) of the steering wheel 8A, and the ordinate indicates the steering angle β (degree) of the outboard motor 4, so that FIG. 13 shows operation angle-steering angle characteristics with respect to a plurality of the pseudo engine rotational speeds. When the pseudo engine rotational speed is kept constant, the steering angle β shows a steady increase with respect to the increase of the operation angle (absolute value). For the same operation angle, the smaller the pseudo engine rotational speed is, the larger the steering angle β is. In other words, for the same operation angle, the larger the pseudo engine rotation speed is, the smaller the steering angle β is. Moreover, the smaller the pseudo engine rotational speed is, the larger the maximum value of the steering angle β is. In other words, the larger the pseudo engine rotational speed is, the smaller the maximum value of the steering angle β is. In the example shown in FIG. 13, the operation angle range of the steering wheel 8A is restricted to, for example, a range of about 135 degrees to the left and right, so that the steering angle β takes a maximum value for the associated pseudo engine rotational speed at the end of the operation angle range.

As shown in FIG. 3, a steering characteristic setter 59 having an input operable by a user, a boatbuilder, or a maintenance worker may be provided. The controller 60 may be configured or programmed to change the steering characteristic in accordance with the settings by the steering characteristic setter 59.

Figure 14:
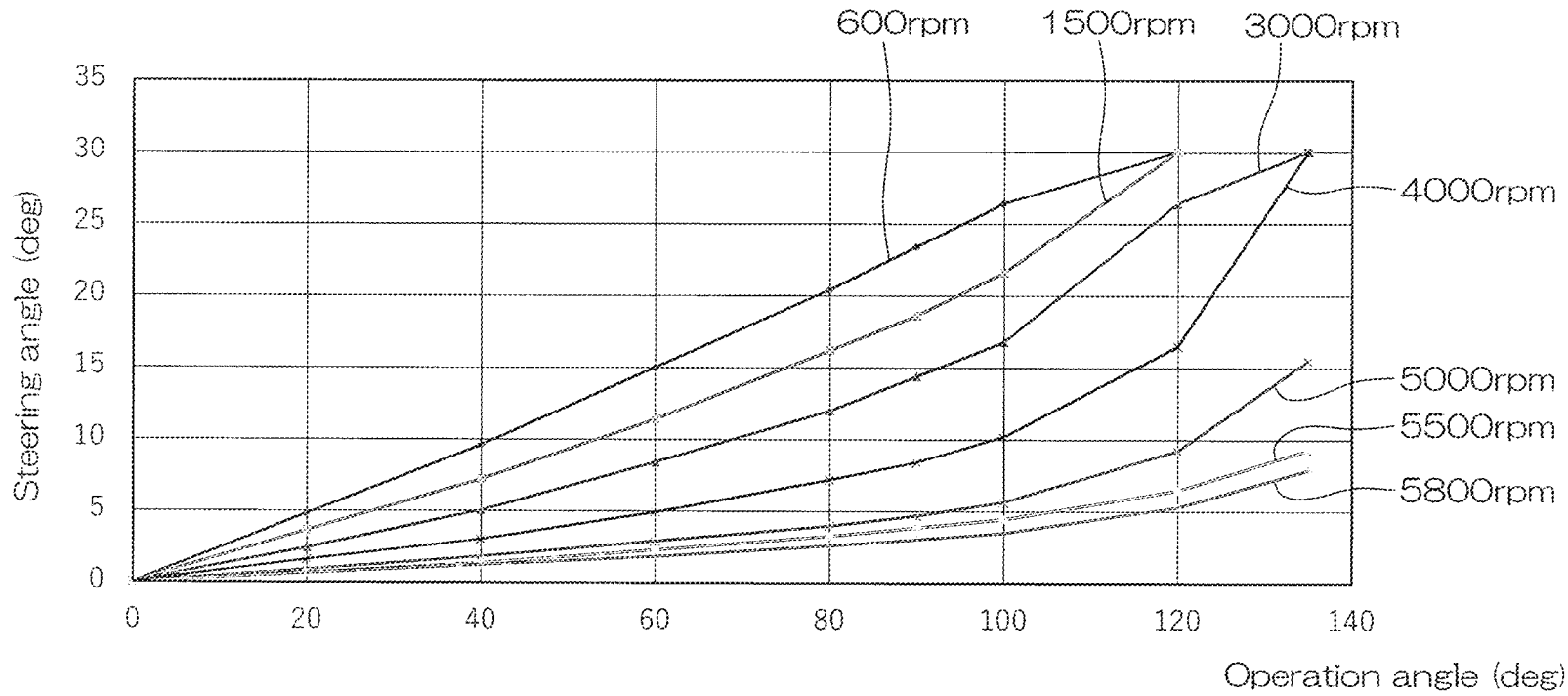
Figure 15:
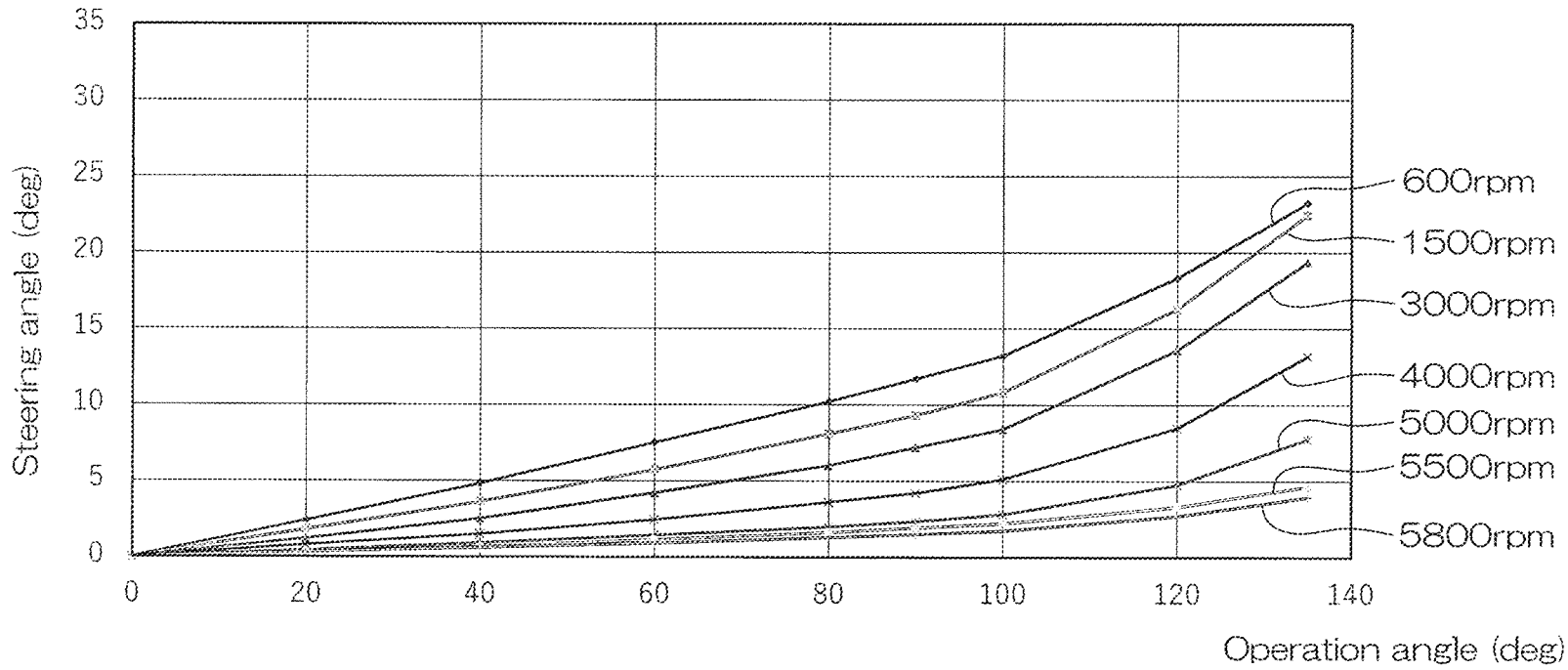

FIG. 14 and FIG. 15 are graphs to describe examples of steering characteristic settings. FIG. 14 shows a two-dimensional expression example of a three-dimensional map that defines a relatively sensitive steering characteristic.

Letting the steering characteristic of FIG. 13 be a reference, the rate of change of the steering angle β with respect to the change in the operation angle is larger in the steering characteristic shown in FIG. 14, so that FIG. 14 defines a characteristic in which steering angle β sensitively changes with respect to the steering wheel operation. In the steering characteristic shown in FIG. 14, the steering angle β is larger for the same operation angle, and the maximum value of the steering angle β is also larger in comparison with the steering characteristic of FIG. 13.

Again, letting the steering characteristic of FIG. 13 be a reference, the rate of change of the steering angle β with respect to the change in the operation angle is smaller in the steering characteristic shown in FIG. 15, so that FIG. 15 defines a characteristic in which steering angle β changes with respect to the steering wheel operation is not sensitive. In the steering characteristic shown in FIG. 15, the steering angle β is smaller for the same operation angle, and the maximum value of the steering angle β is also smaller in comparison with the steering characteristic of FIG. 13.

It should be noted that the steering angle upper limit, i.e., the turnable angle of the outboard motor 4, is 30 degrees in the present preferred embodiment, and the steering characteristics are defined in a range not exceeding the steering angle upper limit.

Figure 16:
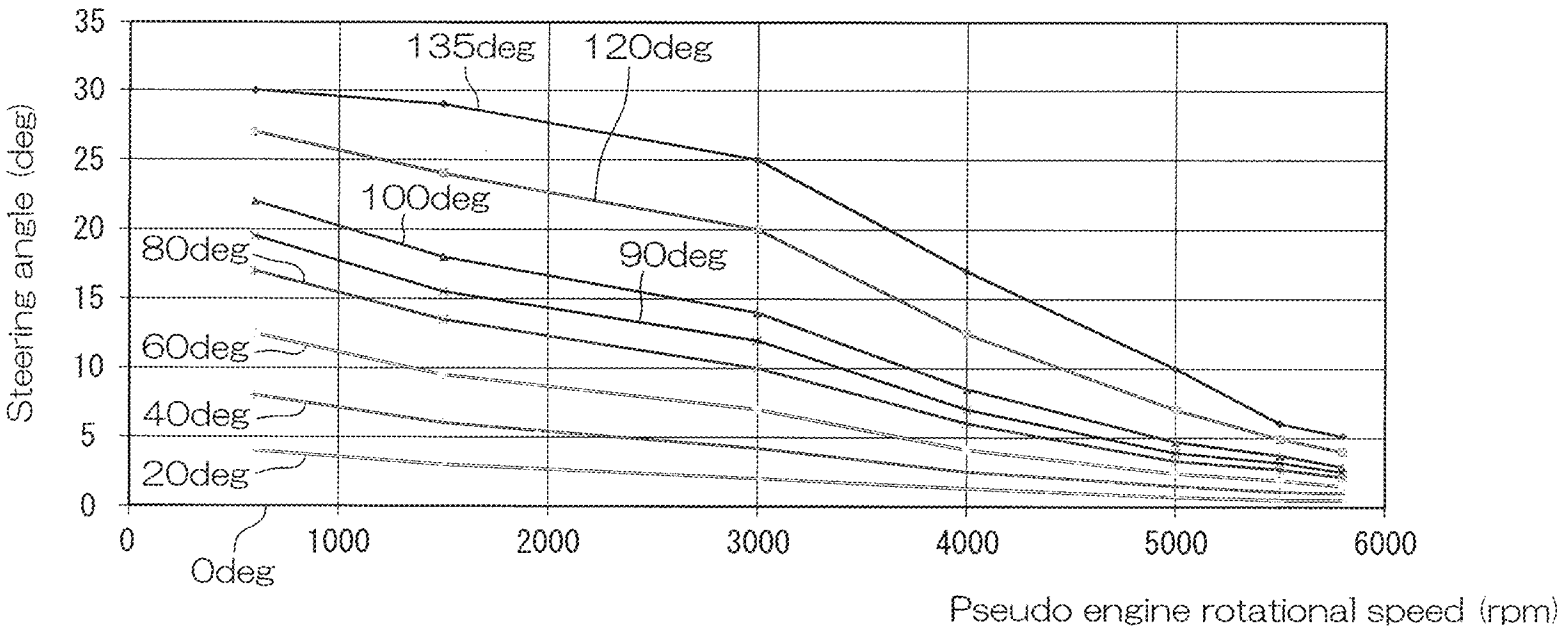
FIGS. 16, 17, and 18 show examples of another two-dimensional expression of the three-dimensional maps.

FIG. 16 shows another example of a two-dimensional expression of a three-dimensional map corresponding to one of the three-dimensional curved surfaces, for example, the three-dimensional curved surface C2. Specifically, this is another expression example of the three-dimensional map of FIG. 13. The abscissa indicates the pseudo engine rotational speed (rpm), and the ordinate indicates the steering angle β (degree) of the outboard motor 4, so that FIG. 16 shows pseudo engine rotational speed-steering angle characteristics with respect to a plurality of the steering wheel operation angles (degrees). When the operation angle is kept constant, the steering angle β of the outboard motor 4 shows a steady increase with respect to the increase of the pseudo engine rotational speed. A curved line in the case of the 135 degree operation angle corresponds to the case in which the steering wheel operation angle is maximum. The characteristic of this curved line indicates that the larger the pseudo engine rotational speed is, the smaller the maximum value of the steering angle β is.

Figure 17:
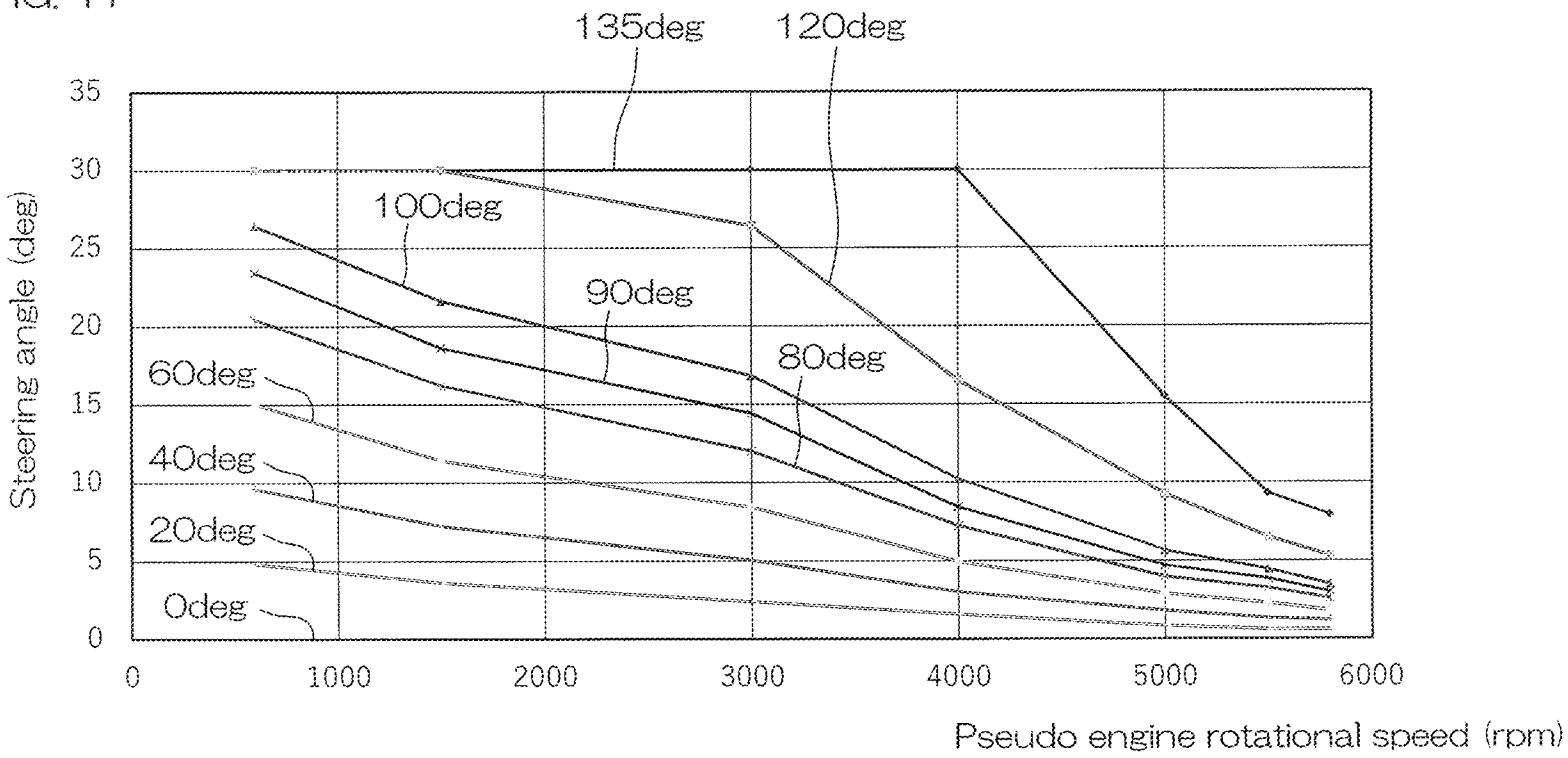

FIG. 17 shows a similar expression example of the three-dimensional map defining a more sensitive steering characteristic which corresponds to the steering characteristic of FIG. 14. Compared with the steering characteristic of FIG. 16, a larger steering angle β is assigned for the same pseudo engine rotational speed. Moreover, the steering angle β changes more sensitively in accordance with the change of the pseudo engine rotation speed. It is recognized from the curved line in the case of the 135 degree operational angle which indicates the maximum value of the steering angle β that the upper limit steering angle β, 30 degrees, is permitted for a larger pseudo engine rotational speed.

Figure 18:
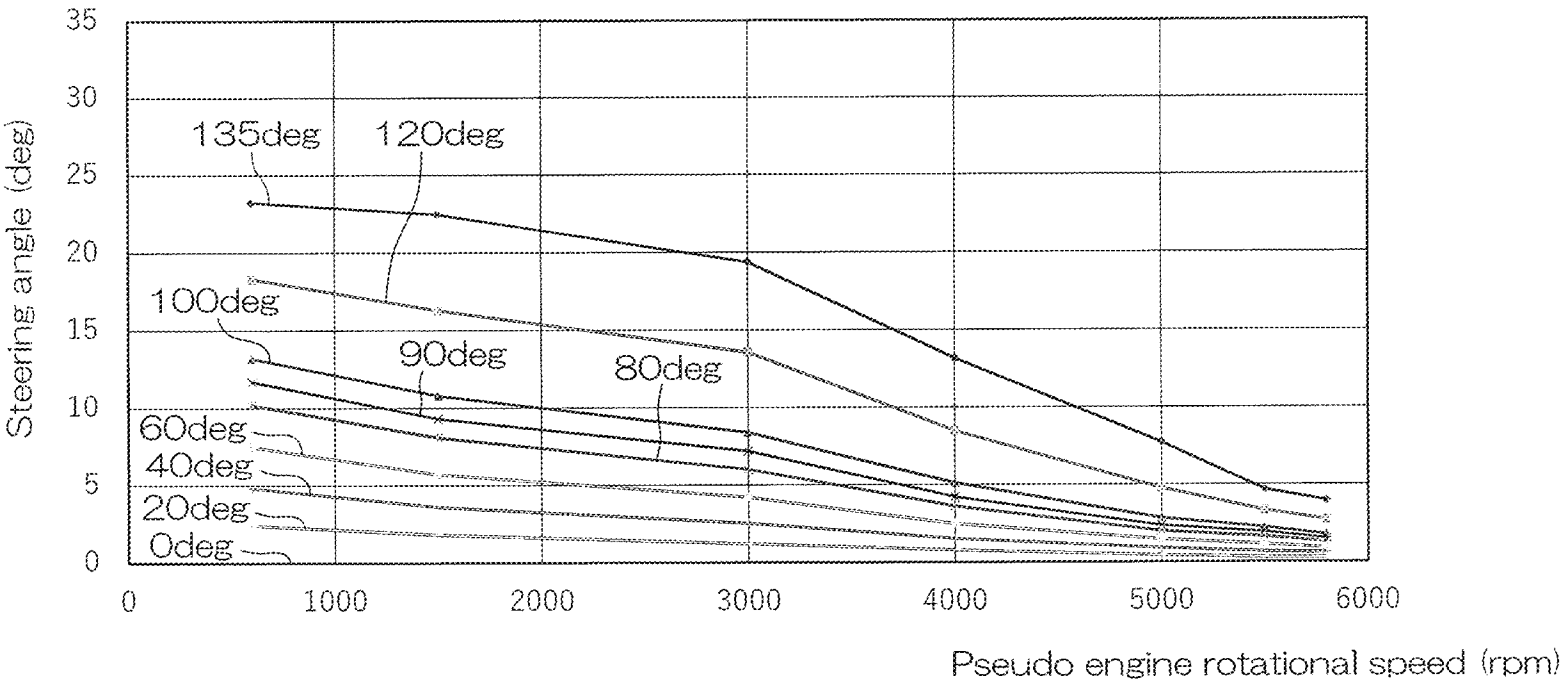

FIG. 18 shows another similar expression example of the three-dimensional map defining a less sensitive steering characteristic which corresponds to the steering characteristic of FIG. 15. Compared with the steering characteristic of FIG. 16, a smaller steering angle β is assigned for the same pseudo engine rotational speed. Moreover, the steering angle β changes less sensitively in accordance with the change of the pseudo engine rotation speed. It is recognized from the curved line in the case of the 135 degree operational angle which indicates the maximum value of the steering angle β that a pseudo engine rotational speed range in which the upper limit steering angle β, 30 degrees, is permitted is shifted to the lower speed side. Specifically, there is no pseudo engine rotational speed range in which the upper limit steering angle is permitted.

Figure 19:
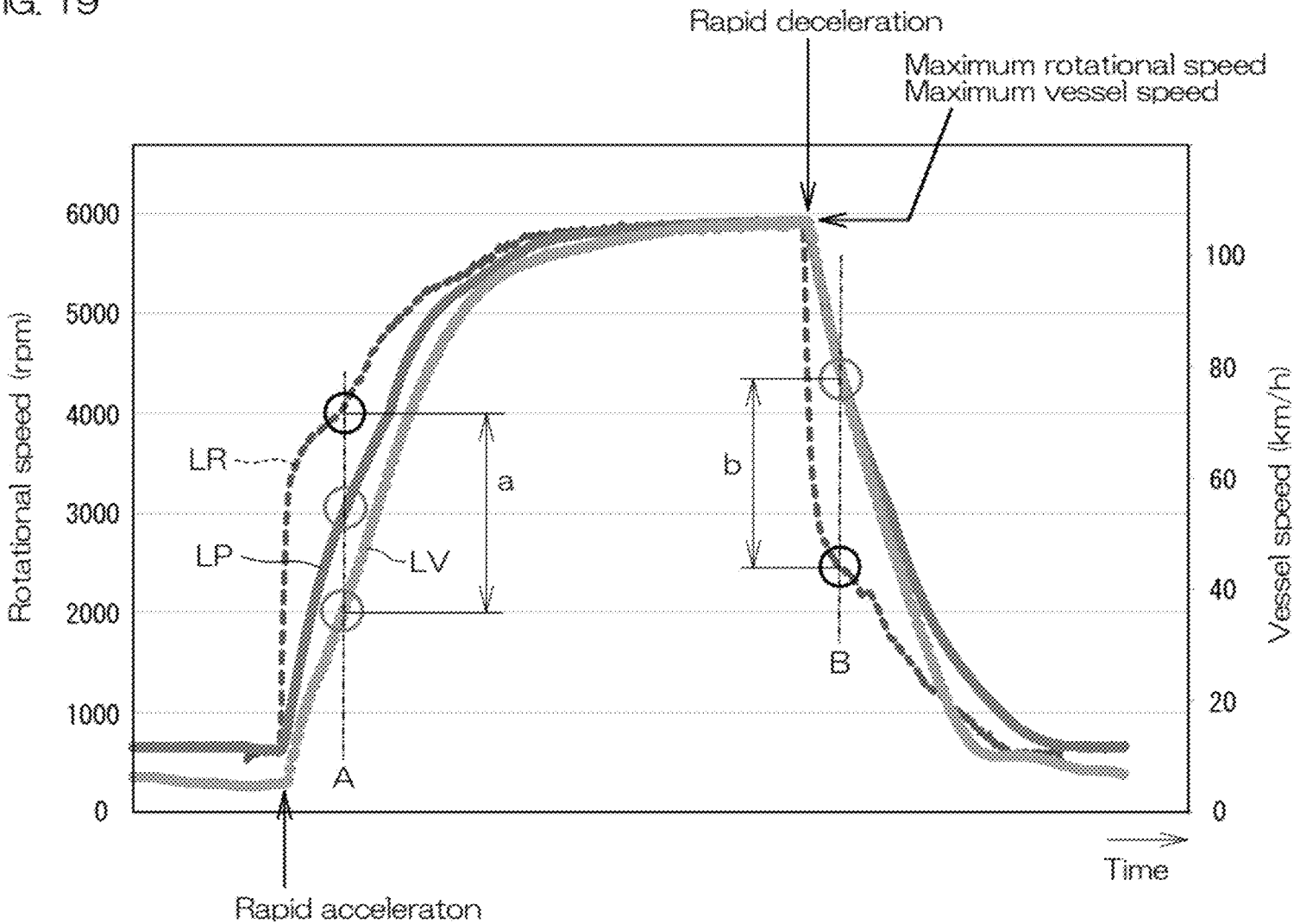
FIG. 19 is a chart to describe differences among a traveling speed of the vessel (vessel speed), an engine rotational speed, and a pseudo engine rotational speed, and shows their changes with respect to time during transient periods.

FIG. 19 is a chart to describe differences among the traveling speed of the vessel 1 (vessel speed), the engine rotational speed, and the pseudo engine rotational speed. A curved line LV indicates a change of the traveling speed of the vessel 1 with respect to time. The traveling speed may be obtained with use of a pitot tube or moving speed data output by a GPS receiver. A curved line LR indicates the change of the engine rotational speed with respect to time. The engine rotational speed may be obtained from the output signal of the engine rotational speed sensor 50B (see FIG. 3). A curved line LP indicates the change of the pseudo engine rotation speed with respect to time. The pseudo engine rotational speed may be obtained by subjecting the engine rotational speed of the curved line LR to a smoothing filter process 60F (see FIG. 3) such as a low pass filtering.

In the above description with reference to FIGS. 11 to 18, the pseudo engine rotational speed is used as an example of the speed data. The traveling speed and the engine rotational speed are other examples of the speed data, so that the term "pseudo engine rotational speed" may be replaced with "traveling speed" or "rotational speed" in the above description. However, it may be preferable to use the pseudo engine rotational speed as the speed data for the reasons described below.

When the throttle lever 9 is operated to accelerate the vessel 1, the engine rotational speed (curved line LR) increases, and then the traveling speed increases to follow the engine rotational speed. That is, the increase of the traveling speed is delayed with respect to the increase of the engine rotational speed. Further, the rate of increase of the traveling speed is smaller than the rate of increase of the engine rotational speed. For example, a large difference "a" is a result at time A, accordingly. Specifically, the engine rotational speed corresponding to the traveling speed (curved line LV) is 2000 rpm at time A, whereas the real engine rotational speed (curved line LR) is 4000 rpm at time A. In this case, a better operation feeling results by using the steering angle β corresponding to the engine rotational speed of 2000 rpm. When the throttle lever 9 is operated to decelerate the vessel 1, the engine rotational speed (curved line LR) decreases, and then the traveling speed decreases to follow the engine rotational speed. That is, the decrease of the traveling speed is delayed with respect to the decrease of the engine rotational speed. Further, the rate of decrease of the traveling speed is smaller than the rate of decrease of the engine rotational speed. For example, a large difference "b" is a result at time B, accordingly. Specifically, the engine rotational speed corresponding to the traveling speed (curved line LV) is 4500 rpm at time B, whereas the real engine rotational speed (curved line LR) is 2400 rpm at time B. In this case, a better operation feeling results by using the steering angle β corresponding to the engine rotational speed of 4500 rpm.

The pseudo engine rotational speed (curved line LP) is closer to the traveling speed (curved line LV) than the engine rotational speed (curved line LR) at both the time A and B. Therefore, by using the pseudo engine rotation speed as the speed data, a proper steering angle β results in both the transient periods, i.e., the acceleration period and the deceleration period, resulting in a good operation feeling. In addition, it is possible to tune the operation feeling by properly setting the characteristics of the smoothing filter process 60F to obtain the pseudo engine rotational speed based on the detected engine rotational speed. A better operation feeling may thus be attained than in the case that the steering angle β is controlled in accordance with the travelling speed (see curved line LV).

The detection of the engine rotational speed is necessary for the control of the outboard motor 4 in most cases, the control of the engine 29 in particular, so that it is unnecessary in most cases to add a special sensor. Specifically, for the detection of the traveling speed, a special sensor such as a pitot tube becomes necessary. When the pseudo engine rotational speed is used as the speed data, on the other hand, no such special sensor is necessary. If a GPS receiver is provided to detect the position of the vessel 1, the moving speed data output by the GPS receiver is available. However, a GPS receiver is not always provided in the vessel 1. In addition, a GPS receiver does not output the moving speed data in some circumstances such as when traveling under a bridge, so that it may not be expected to stably obtain the moving speed data from the GPS receiver.

Although preferred embodiments of the present invention have been described above, the present invention is not restricted to the contents of these preferred embodiments and various modifications are possible within the scope of the present invention.

For example, a leftward movement has been described concerning the movement of the vessel 1, and yet this lateral movement is only an example. Therefore, an arrangement that is one of the features of the present invention in which the maximum value of the steering angle β is set to be changeable between the first set value and the second set value is applicable to movements (including a translational movement) in all directions including a right-left direction component of a diagonal movement or the like, and is also applicable to movements (for example, turning during ordinary traveling) other than the translational movement. The maximum value of the steering angle β may be set at three or more set values without being limited to the first and second set values.

Additionally, an inboard/outboard motor or a waterjet drive may be used as an example of a propulsion apparatus other than the outboard motor 4. The inboard/outboard motor is a motor in which a prime mover is located inside the vessel and in which a drive unit including a thrust generating member and a steering mechanism is located outside the vessel. An inboard motor includes both a prime mover and a drive unit built into the hull 2 and in which a propeller shaft extends from the drive unit to the outside of the vessel. In this case, a steering mechanism is separately provided. The waterjet drive obtains a thrust by accelerating water sucked from a vessel bottom with a pump and by jetting the water from the jet nozzle of the stern. In this case, the steering mechanism includes a jet nozzle and a mechanism that turns the jet nozzle along a horizontal plane.

Also, features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel operation system to be installed on a vessel, the vessel operation system comprising:

a propulsion apparatus mountable on a hull of the vessel, the propulsion apparatus including a prime mover and generating a thrust based on a drive force generated by the prime mover;

a steering to change a steering angle of a thrust generated by the propulsion apparatus with respect to the hull;

a speed sensor to detect a speed corresponding to a traveling speed of the vessel or a rotational speed of the prime mover; and a controller configured or programmed to control the steering so as to change a maximum value of the steering angle in accordance with speed data based on the speed detected by the speed sensor; wherein the controller is configured or programmed to:

set the maximum value of the steering angle at a first set value when the speed data is a predetermined threshold value or more; and set the maximum value of the steering angle at a second set value larger than the first set value when the speed data is less than the threshold value.

2. The vessel operation system according to claim 1, wherein the speed data is the speed detected by the speed sensor, or a pseudo speed corresponding to the speed detected by the speed sensor subjected to a smoothing filter process.

3. The vessel operation system according to claim 1, wherein the threshold value corresponds to the speed data when the vessel starts to plane on a water surface.

4. The vessel operation system according to claim 1, further comprising:

a plurality of the propulsion apparatuses mountable on the hull and arranged side-by-side in a left-right direction of the hull; wherein the second set value is determined so that an intersection position between acting lines of thrusts generated by the plurality of propulsion apparatuses is changeable in a range including a resistant center of the hull, a more forward position than the resistant center, and a more rearward position than the resistant center.

5. The vessel operation system according to claim 4, wherein the second set value is about 30 degrees or more when the steering angle corresponding to the acting line extending in the front-rear direction is 0 degrees.

6. The vessel operation system according to claim 1, wherein the propulsion apparatus is an outboard motor that is turnable around a vertical shaft, and the second set value is equal to a turnable angle of the outboard motor.

7. A vessel operation system to be installed on a vessel, the vessel operation system comprising:

a propulsion apparatus mountable on a hull of the vessel and that generates a thrust;

a steering to change a steering angle of a thrust generated by the propulsion apparatus with respect to the hull;

a first operator operable by a vessel operator to generate a first vessel operation command;

a second operator separate from the first operator and operable by the vessel operator to generate a second vessel operation command; and a controller configured or programmed to control the steering within a maximum steering angle of a first set value in response to the first vessel operation command, and to control the steering within a maximum steering angle of a second set value larger than the first set value in response to the second vessel operation command.

8. The vessel operation system according to claim 7, wherein the second operator is a joystick.

9. The vessel operation system according to claim 7, further comprising:

a plurality of the propulsion apparatuses mountable on the hull and arranged side-by-side in a left-right direction of the hull; wherein the second set value is determined so that an intersection position between acting lines of thrusts generated by the plurality of propulsion apparatuses is changeable in a range including a resistant center of the hull, a more forward position than the resistant center, and a more rearward position than the resistant center.

10. The vessel operation system according to claim 9, wherein the second set value is about 30 degrees or more when the steering angle corresponding to the acting line extending in the front-rear direction is 0 degrees.

11. The vessel operation system according to claim 7, wherein the propulsion apparatus is an outboard motor that is turnable around a vertical shaft, and the second set value is equal to a turnable angle of the outboard motor.

12. A vessel operation system to be installed on a vessel, the vessel operation system comprising:

a propulsion apparatus mountable on a hull of the vessel, the propulsion apparatus including a prime mover and generating a thrust based on a drive force generated by the prime mover;

a steering to change a steering angle of a thrust generated by the propulsion apparatus with respect to the hull;

a speed sensor to detect a speed corresponding to a traveling speed of the vessel or a rotational speed of the prime mover;

a steering wheel operable by an operator; and a controller configured or programmed to control the steering so as to change the steering angle in accordance with speed data, wherein the speed data is the traveling speed detected by the speed sensor or a pseudo rotational speed corresponding to the rotational speed detected by the speed sensor subjected to a smoothing filter process; wherein the controller is configured or programmed to control the steering to change the steering angle in accordance with the speed data even when an operation angle of the steering wheel is unchanged.

13. The vessel operating system according to claim 12, wherein the controller is configured or programmed to control the steering when the operation angle of the steering wheel is unchanged such that the larger the speed data is, the smaller the steering angle is.

14. The vessel operating system according to claim 12, wherein the controller is configured or programmed to determine a target steering angle in accordance with a three-dimensional map including a three-dimensional curved surface that defines the target steering angle in relation to the operation angle of the steering wheel and the speed data, and to control the steering in accordance with the determined target steering angle.

15. A vessel operation system to be installed on a vessel, the vessel operation system comprising:

a propulsion apparatus mountable on a hull of the vessel, the propulsion apparatus including a prime mover and generating a thrust based on a drive force generated by the prime mover;

a steering to change a steering angle of a thrust generated by the propulsion apparatus with respect to the hull;

a speed sensor to detect a speed corresponding to a traveling speed of the vessel or a rotational speed of the prime mover;

a controller configured or programmed to control the steering so as to change the steering angle in accordance with speed data, wherein the speed data is the traveling speed detected by the speed sensor or a pseudo rotational speed corresponding to the rotational speed detected by the speed sensor subjected to a smoothing filter process;

a steering wheel operable by an operator and a steering characteristic setter; wherein the controller is configured or programmed to change a characteristic of the steering angle with respect to an operation angle of the steering wheel and/or a characteristic of the steering angle with respect to the speed data.

16. A vessel comprising:

a hull; and the vessel operation system according to claim 1 mounted on the hull.

17. A vessel comprising:

a hull; and the vessel operation system according to claim 7 mounted on the hull.

18. A vessel comprising:

a hull; and the vessel operation system according to claim 12 mounted on the hull.

19. A vessel comprising:

a hull; and the vessel operation system according to claim 15 mounted on the hull.

* * * * *